US012161176B2

(12) United States Patent
Kukathas et al.

(10) Patent No.: US 12,161,176 B2
(45) Date of Patent: Dec. 10, 2024

(54) APRON AND SELF-ADJUSTING STRAP LOAD EQUALIZING SYSTEM THEREFOR

(71) Applicant: 0950300 B.C. Ltd., Squamish (CA)

(72) Inventors: Nathan Phillip Kukathas, Squamish (CA); Zachary Goldberg-Poch, Squamish (CA)

(73) Assignee: 0950300 B.C. LTD., Squamish (CA)

( * ) Notice: Subject to any disclaimer, the term of this patent is extended or adjusted under 35 U.S.C. 154(b) by 0 days.

(21) Appl. No.: 17/889,860

(22) Filed: Aug. 17, 2022

(65) Prior Publication Data

US 2023/0074007 A1 Mar. 9, 2023

Related U.S. Application Data

(60) Provisional application No. 63/234,387, filed on Aug. 18, 2021.

(51) Int. Cl.
*A41D 13/04* (2006.01)

(52) U.S. Cl.
CPC ..... *A41D 13/046* (2013.01)

(58) Field of Classification Search
CPC ..... A41D 13/046; A41D 13/02; A41D 13/04; A41D 1/21; A41D 1/215; A41D 27/24; A47D 13/025
See application file for complete search history.

(56) References Cited

U.S. PATENT DOCUMENTS 363,790 A * 5/1887 Alley ..... A41D 13/04 2/51
396,282 A * 1/1889 Levin ..... A41D 13/04 2/51
2,083,790 A * 6/1937 Mcguire ..... B24D 9/02 24/130
2,148,152 A * 2/1939 Dosberg ..... A41D 13/04 2/52
2,420,091 A * 5/1947 Nordling ..... A41D 13/0512 D2/860
2,426,565 A * 8/1947 Quinn ..... A41D 13/04 2/52

(Continued)

FOREIGN PATENT DOCUMENTS

JP 2003193307 A 7/2003
TW M258607 U 3/2005

*Primary Examiner* — Jillian K Pierorazio
(74) *Attorney, Agent, or Firm* — Nicholas Garner; Oyen Wiggs Green & Mutala LLP

(57) ABSTRACT

There is provided an apron according to one aspect. The apron includes a bib having a top and spaced-apart sides. The apron includes a first strap having a pair of spaced-apart ends which couple to and extend outwards from the top of the bib. The apron includes a second strap which couples to and extends between the sides of the bib. The apron includes a coupling member positioned between the sides of the bib. The coupling member slidably couples together the first strap and the second strap.

There is further provided a tie-free apron according to yet another aspect. The apron includes a bib having a top and spaced-apart sides. The apron includes a self-adjusting strap load equalizing system. The self-adjusting strap load equalizing system includes a neck-yoke strap, a back strap, and a coupling member which slidably couples together the straps.

20 Claims, 22 Drawing Sheets

(56) References Cited

U.S. PATENT DOCUMENTS 2,442,895 A * 6/1948 Harvey ..... A41D 13/04 2/48
2,451,282 A * 10/1948 Feibel ..... G21F 3/03 2/457
2,565,739 A * 8/1951 Pointen ..... A41D 13/04 2/51
3,801,985 A * 4/1974 Batt ..... A41D 13/04 2/48
4,030,139 A * 6/1977 Sonntag ..... A41D 13/04 2/51
4,231,119 A * 11/1980 Quinn ..... A41D 13/04 2/48
4,412,369 A * 11/1983 Carnaghi ..... A41D 13/04 2/48
4,434,920 A * 3/1984 Moore ..... A47D 13/025 224/160
4,682,372 A * 7/1987 Peterson ..... A41D 13/04 2/51
4,850,051 A 7/1989 Hodge
4,986,458 A * 1/1991 Linday ..... A47D 13/025 224/648
5,082,289 A * 1/1992 Paranto ..... A63B 67/002 473/505
5,454,498 A * 10/1995 Dunn ..... A47D 13/025 224/160
5,540,188 A * 7/1996 Heinrichs ..... A47D 13/086 119/770
5,829,056 A 11/1998 Hubert
6,243,869 B1 6/2001 Ekovich
6,421,833 B2 * 7/2002 Khanamirian ..... A41D 13/0007 2/69
6,626,131 B2 * 9/2003 Moulton, III ..... A01K 27/00 119/770
6,735,780 B1 * 5/2004 Jaunault ..... A41D 13/043 2/48
7,636,949 B1 12/2009 Shooshan
9,265,294 B2 2/2016 Ellis et al.
10,259,167 B2 4/2019 Ellis et al.
D850,021 S * 5/2019 Yun ..... D30/152
10,602,783 B1 * 3/2020 Colligan ..... A41D 15/04
2005/0179244 A1 * 8/2005 Schroth ..... B60R 22/14 280/808
2005/0218168 A1 * 10/2005 Chua ..... A41B 13/06 224/160
2005/0278819 A1 * 12/2005 Munn ..... A62B 35/0018 2/69
2016/0007673 A1 * 1/2016 McDonald ..... H01L 29/78 36/11.5
2016/0143377 A1 * 5/2016 Kuru ..... A41D 13/046 2/48
2016/0213166 A1 * 7/2016 Law ..... A47D 13/046

* cited by examiner

APRON AND SELF-ADJUSTING STRAP LOAD EQUALIZING SYSTEM THEREFOR

BACKGROUND OF THE INVENTION

Field of the Invention

There is provided an apron. In particular, there is provided an apron and a self-adjusting strap load equalizing system therefor.

Description of the Related Art

United States Patent Application Publication No. 2016/0143377 A1 to Kuru discloses a tie-free apron. The apron includes a bib with a front, a back, top and bottom edges, and first side and second side edges extending from the top edge to the bottom edge. The apron includes two shoulder straps with a first end attached to the top edge of the bib and a second end. The apron includes a back pad with a top edge attached to the second end of each of the two shoulder straps, first and second side edges, and a bottom edge. The apron includes a first waist strap with a first end attached to the first side edge of the back patch and a second end attached to the first side edge of the bib using a first adjustable attachment. The apron includes a second waist strap with a first end attached to the second side edge of the back patch and a second end attached to the second edge of the bib using a second adjustable attachment.

BRIEF SUMMARY OF INVENTION

There is provided, and it is an object to provide, an improved apron and self-adjusting strap load equalization system therefor.

There is accordingly provided an apron according to one aspect. The apron includes a bib having a top and spaced-apart sides. The apron includes a first strap having a pair of spaced-apart ends which couple to and extend outwards from the top of the bib. The apron includes a second strap which couples to and extends between the sides of the bib. The apron includes a coupling member positioned between the sides of the bib. The coupling member slidably couples together the first strap and the second strap.

There is also provided an apron according to another aspect. The apron includes a bib, a first strap and a second strap. The bib and the first strap form a first loop. The bib and the second strap form a second loop. The apron includes a coupling member via which the first loop and the second loop slidably couple.

There is further provided an apron according to yet another aspect. The apron includes a bib having a top and spaced-apart sides. The apron includes a self-adjusting strap load equalizing system. The self-adjusting strap load equalizing system includes a neck-yoke strap, a back strap, and a coupling member which slidably couples together the straps.

There is additionally provided an apron according to a further aspect. The apron includes a bib. The bib includes an upper hem and a pair of spaced-apart side hems. The apron includes a pair of strap adjustment mechanisms positioned within the side hems of the bib. The apron includes a strap assembly. The strap assembly includes upper end portions that are anchored to and positioned within the upper hem of the bib. The strap assembly includes lower end portions configured to extend through the strap adjustment mechanisms.

Each of the above referred-to aprons may comprise tie-free aprons.

It is emphasized that the invention relates to all combinations of the above features, even if these are recited in different claims.

Further aspects and example embodiments are illustrated in the accompanying drawings and/or described in the following description.

BRIEF DESCRIPTION OF DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
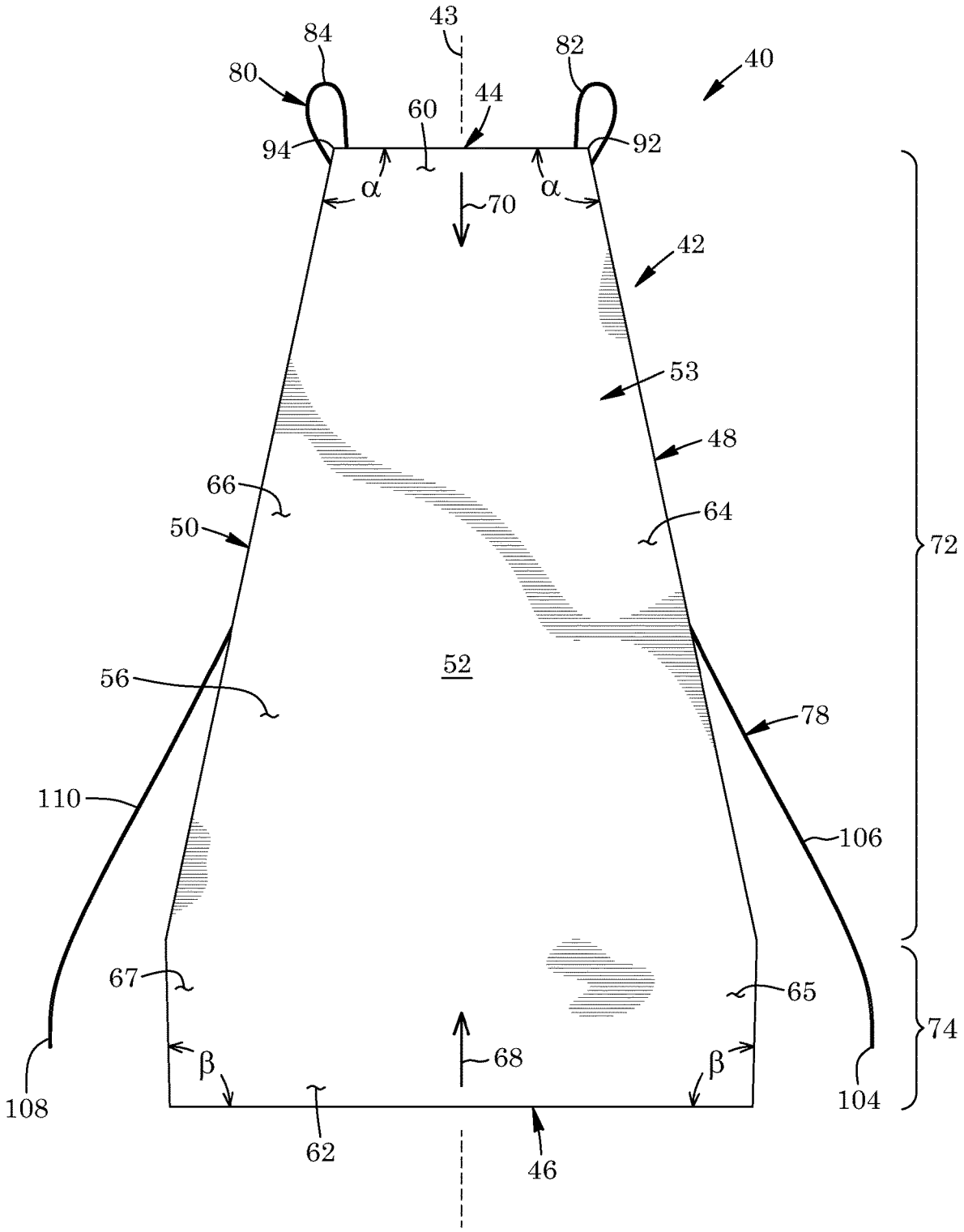
FIG. 1 is a front elevation view of an apron according to a first aspect, the apron including a self-adjusting strap load equalizing system.

Referring to the drawings and first to FIG. 1, there is shown an apron, in this example a tie-free apron 40. The apron may also be referred to as a tieless apron. Apron 40 includes a bib 42. The bib is substantially planar when not in use in this example. Bib 42 has a top 44, a bottom 46 spaced-apart from the top, a first or left side 48, and a second or right side 50 spaced-apart from the first side. The sides of the bib extend from the bottom of the bib to the top of the bib. Bottom 46 of bib 42 is wider than top 44 of the bib in this example.

The bib has a longitudinal axis 43 which extends through the top and bottom thereof and which is positioned between sides 48 and 50 thereof. Each of sides 48 and 50 of bib 42 extends from top 44 of the bib at an obtuse angle $\alpha$ relative to the top of the bib in this example. Each of the sides of bib 42 extends from bottom 46 of the bib at an angle $\beta$ that is obtuse relative to the bottom of the bib in this example. However, this is not strictly required and angle $\beta$ may be equal to 90 degrees in other embodiments.

Still referring to FIG. 1, bib 42 has an exterior surface or front side 52 that faces outwards when in use. The front side of the bib is seamless and free of stitching. Front 53 of apron 40 is thus void of all seams, pockets, logos, stitching, loops, rivets, zips, or other disruptions. The result may be a totally 'clean' look.

Figure 2:
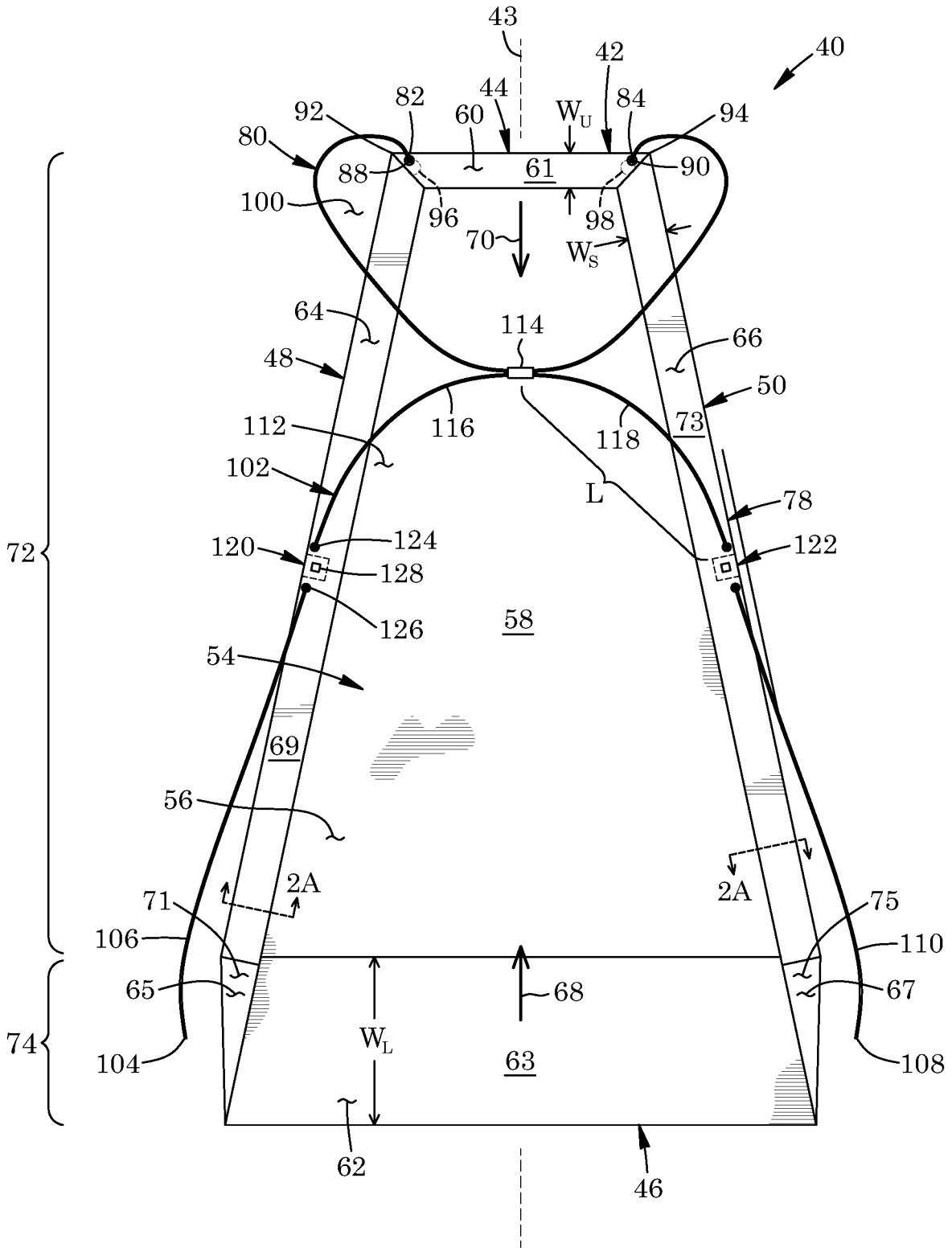
FIG. 2 is a rear elevation view thereof.

As seen in FIG. 2, bib 42 has an interior surface or inner side 54 opposite front side 52 thereof. The bib includes an inner portion 56. The inner portion is an isosceles trapezoid in shape in this example. Bib 42 includes a lining 58 coupled to inner portion 56 thereof. The lining is coplanar with the inner portion of the bib in this example. Lining 58 extends along and about inner portion 56 of the bib in this example.

Still referring to FIG. 2, bib 42 includes one or more peripheral portions, in this example top peripheral portion 60, bottom peripheral portion 62, upper side peripheral portion 64, lower side peripheral portion 65, upper side peripheral portion 66 and lower side peripheral portion 67. The peripheral portions of the bib extend about inner portion 56 thereof. The inner portion of bib 42 is spaced inwards from peripheral portions 60, 62, 64, 65, 66 and 67 of the bib.

Top peripheral portion 60 of the bib aligns with top 44 of the bib. Top peripheral portion 60 of bib 42 extends from the top of the bib towards bottom 46 of the bib. Bottom peripheral portion 62 of the bib aligns with the bottom of the bib. The bottom peripheral portion of bib 42 extends from bottom 46 of bib 42 towards top 44 of the bib.

Upper side peripheral portion 64 and lower side peripheral portion 65 of the bib align with side 48 of the bib and extend from side 48 towards side 50 of the bib. Upper side peripheral portion 66 and lower side peripheral portion 67 of bib 42 align with side 50 of the bib and extend from side 50 towards side 48 of the bib. Lower side peripheral portions 65 and 67 couple to bottom 46 of the bib and extend from the bottom towards the top of the bib. The lower side peripheral portions of the bib flare in a direction 68 extending from the bottom towards the top of the bib in this example. Upper side peripheral portions 64 and 66 couple to top 44 of bib 42 and extend from the top towards bottom 46 of the bib. The upper side peripheral portions of the bib taper in a direction 70 extending from the top of the bib towards the bottom of the bib. Upper side peripheral portions 64 and 66 extend diagonally in use and relative to longitudinal axis 43 in this example.

As seen in FIG. 1, bib 42 is an elongate hexagonal in shape in this example. The bib may be said to comprise an isosceles trapezoid in shape with removed or folded-in bottom corners. Bib 42 includes an upper portion 72 enclosed by top 44 and sides 48 and 50 of the bib adjacent upper side peripheral portions 64 and 66 of the bib. The upper portion of the bib is an isosceles trapezoid in shape in this example. Bib 42 includes a lower portion 74 enclosed by bottom 46 and sides 48 and 50 of the bib adjacent lower side peripheral portions 65 and 67 of the bib. The lower portion of the bib is an inverted isosceles trapezoid in shape in this example; however this is not strictly required and the lower portion of the bib may be rectangular in other embodiments.

As seen in FIG. 2, bib 42 includes a plurality of hems, including: an upper hem 61 extending adjacent top 44 thereof and extending along upper peripheral portion 60 thereof; a lower hem 63 extending adjacent bottom 46 thereof and extending along bottom peripheral portion 62 thereof; an upper side hem 69 extending adjacent side 48 and extending along upper side peripheral portion 64 thereof; a lower side hem 71 extending adjacent side 48 and extending along lower side peripheral portion 65; an upper side hem 73 extending adjacent side 50 and extending along upper side peripheral portion 66 thereof; and a lower side hem 75 extending adjacent side 50 and extending along lower side peripheral portion 67. Upper side hems 69 and 73 extend diagonally in use and relative to longitudinal axis 43 in this example.

Figure 2A:
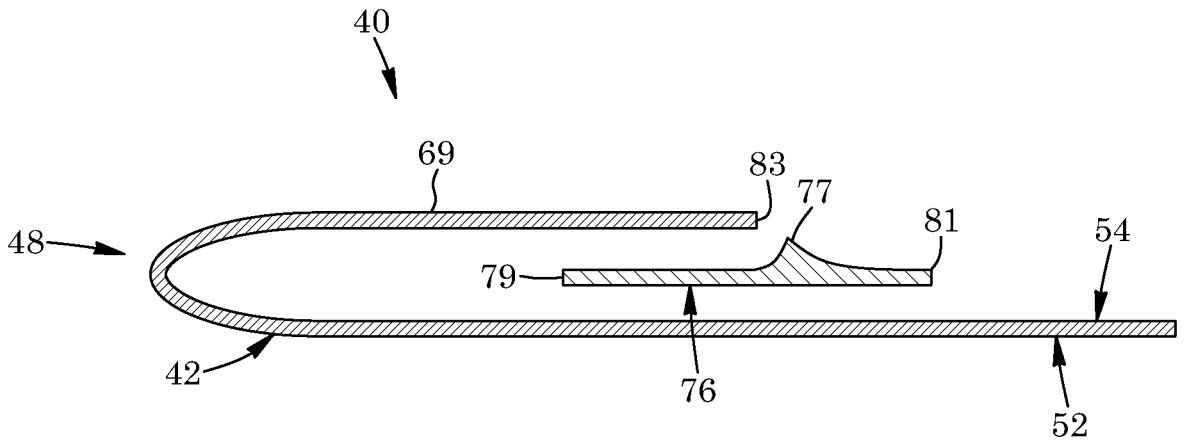
FIG. 2A is a sectional view taken along lines 2A-2A of the apron of FIG. 2.

As seen in FIG. 2A, each hem 73 is bonded to inner side 54 of apron 40 with adhesive, in this example thermo-adhesive film 76. The adhesive film has an outer periphery or end 79 between the hem and front side 52 of bib 42 and an inner periphery or end 81 spaced inwards from the hem. Adhesive film 76 includes an upwardly-extending protrusion, in this example a glue bleed 77 between the ends thereof and which extends beyond edge 83 of the fabric of hem 69 so that some adhesive flows into the edge of the fabric and inhibits fraying and delamination.

Referring to back to FIG. 2, upper hem 61 has a width $W_U$ generally equal to widths $W_S$ of the upper side hems 69 and 73. Lower hem 63 is a large folded up hem, with a width $W_L$ that is larger/wider than widths $W_S$ of the upper side hems and larger/wider than width $W_U$ of the upper hem in this example. The lower hem is shaped to promote tensioning outwards and flattening of bib 42.

Still referring to FIG. 2, apron 40 includes a self-adjusting strap load equalizing system 78. The self-adjusting strap load equalizing system includes a first strap, in this example a neck-yoke strap 80. The neck-yoke strap has a non-adjustable fixed length. Neck-yoke strap 80 has a pair of spaced-apart end portions 82 and 84. The end portion of the neck-yoke strap extend outwards from upper hem 61 and inner side 54 of bib 42 adjacent top 44 of the bib.

Self-adjusting strap load equalizing system 78 includes a pair of spaced-apart eyelets 88 and 90 in this example. The eyelets couple to upper hem 61 adjacent to top 44 of bib 42. Eyelets 88 and 90 in this example are adjacent to corners 92 and 94 of the bib formed where sides 48 and 50 meet top 44 of the bib. The eyelets are located on inner side 54 of bib 42. End portions 82 and 84 of neck-yoke strap 80 extend through eyelets 88 and 90.

Stopping members, in this example in the form of enlarged first and second ends 96 and 98 of the neck-yoke strap, are positioned within upper hem 61. In other embodiments, the ends of neck-yoke strap 80 are not enlarged and the stopping members may comprise protrusions or knobs coupled to and extending radially outwards from the ends of the neck-yoke strap. Enlarged first and second ends 96 and 98 of neck-yoke strap 80 are larger than and abut respective eyelets 88 and 90, and function as anchor points for coupling the neck-yoke strap to upper hem 61 of apron 40. Enlarged end 96 of neck-yoke strap 80 couples to bib 42 adjacent to side 48 of the bib and enlarged end 98 of the neck-yoke strap couples to the bib adjacent to side 50 of the bib. The neck-yoke strap thus couples to and extends from upper hem 61 of bib 42 adjacent top 44 of the bib. Strap 80 therefore couples to and extends from inner side 54 of the bib, with no visible connection to front side 52 of the bib seen in FIG. 1. Referring back to FIG. 2, enlarged ends 96 and 98 of neck-yoke strap 80 may comprise knotted said ends of the neck-yoke strap; however, this is not strictly required. Bib 42 together with neck-yoke strap 80 form a first loop 100.

Apron 40 and self-adjusting strap load equalizing system 78 include a second strap, in this example a back strap 102. Neck-yoke strap 80 and the back strap are shaped to promote a light or 'almost-feather-weight-barely-can-be-felt-hanging-on-your-body' feel. The straps may be referred to collectively as a strap assembly. Enlarged ends 96 and 98 of neck-yoke strap 80 may be referred to as upper end portions of the strap assembly.

Straps 80 and 102 comprise braided cord in this example and are thin, with each having a diameter equal to or less than 3 millimeters in this example. However, this is not strictly required and the straps may be non-braided and have other diameters and be made of other materials in other examples.

Back strap 102 couples to and extends between sides 48 and 50 of bib 42. The back strap has a first end 104 and a first end portion 106 adjacent to and extending upwards from the first end thereof from the perspective of FIG. 2. Back strap 102 has a second end 106 and a second end portion 108 adjacent to and extending upwards from the second end thereof from the perspective of FIG. 2. Enlarged end 96 of neck-yoke strap 80 generally aligns with end 104 and end portion 106 of back strap 102 when in use in this example and enlarged end 98 of the neck-yoke strap generally aligns with end 108 and end portion 110 of the back strap when in use in this example; however, this is not strictly required. End portions 106 and 110 of back strap 102 may be referred to as lower end portions of the strap assembly.

First end portion 106 of the back strap couples to upper side hem 69 and second end portion 110 of the back strap couples to upper side hem 73. Back strap 102 thus couples to and extends from inner side 54 of bib 42, with no visible connection to front side 52 of the bib seen in FIG. 1. Referring back to FIG. 2, straps 80 and 102 are thus anchored to upper hem 61 and upper side hems 69 and 73 on the inside of and/or within the interior of the apron. Bib 42 together with the back strap form a second loop 112.

Apron 40 and self-adjusting strap load equalizing system 78 include a coupling member 114. The coupling member in this example is conduit-shaped. Coupling member 114 is hollow, in this example comprising a sleeve and being tubular in this case; however, the latter is not strictly required. The coupling member is positioned between sides 48 and 50 of bib 42 when bib 42 is in use. Coupling member 114 is positioned between top 44 and bottom 46 of the bib when the bib is in use. The coupling member is positioned to align within inner portion 56 of bib 42 when the bib is in use. Coupling member 114 is shaped to receive neck-yoke strap 80 and back strap 102 therethrough. The coupling member is shaped to slidably couple together the neck-yoke strap and the back strap. First loop 100 and second loop 112 couple together via coupling member 114, in this example slidably coupling together.

Figure 11:
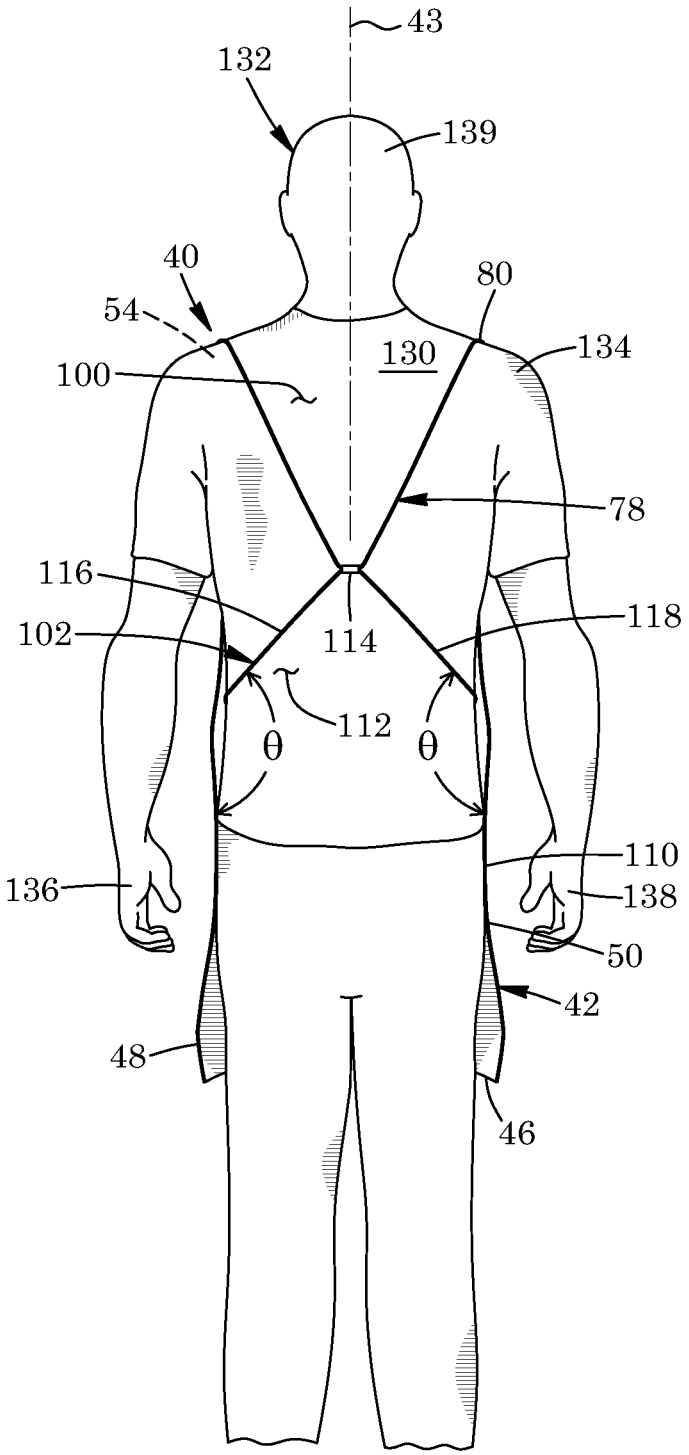
FIG. 11 is a rear perspective view thereof.

As seen in FIG. 11, back strap 102 has a first sub-portion 116 that extends from left side 48 of bib 42 to the coupling member at a first angle θ relative to the first side of the bib when the bib is in use. The back strap has a second sub-portion 118 that extends from right side 50 of the bib to coupling member 114 at a second angle θ relative to the right side of the bib when the bib is in use. The first angle is substantially equal to the second angle in this example. Angles θ are obtuse in this example, with sub-portions 116 and 118 are back strap 102 thus extending inwards and upwards at obtuse angles relative to sides 48 and 50 of bib 42 when the bib is in use. Neck-yoke strap 80 and sub-portions 116 and 118 of back strap 102 may collectively be referred to as a cross-shaped portion of the strap assembly.

Figure 2B:
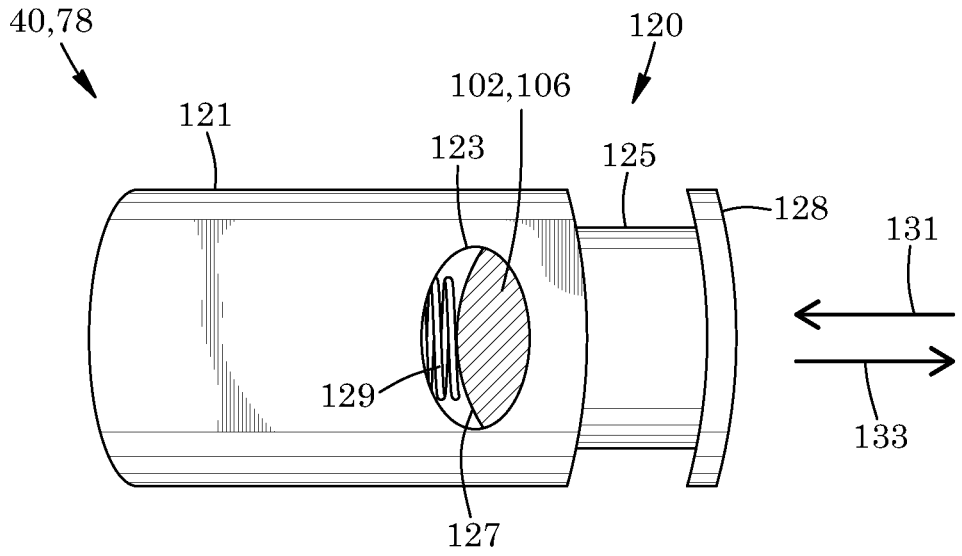
FIG. 2B is a perspective view of a cord lock for the self-adjusting strap load equalizing system of FIG. 1.

Referring back to FIG. 2, apron 40 and self-adjusting strap load equalizing system 78 include at least one and in this example a pair of strap adjustment mechanisms, in this case cord locks 120 and 122. As seen in FIG. 2B, each cord lock 120 in this example may include a first member, in this case a first tubular body 121 with an aperture extending therethrough 123. Each cord lock may include a second member, in this example a second tubular body 125 with an aperture 127 extending therethrough in this example. The second tubular body is shaped to fit within first tubular body 121. Second tubular body 125 is configured to couple to and be resiliently biased outwards from the first tubular body via a resilient member, in this example coil spring 129. Selective retraction of the second tubular body towards/within first tubular body 121 (as shown by arrow 131) promotes alignment of apertures 123 and 127, thereby enabling end portion 106 of back strap 102 to selectively extend through the apertures and be adjusted.

When the back strap has been adjusted to a desired position, second tubular body 125 is released, causing the second tubular body to bias outwards from first tubular body 121 once more towards an extended position as seen by arrow 133. Cord lock 120 in the extended position causes end portion 106 of back strap 102 to be squeezed/clamped between tubular bodies 121 and 125, thus inhibiting movement/adjustment of the end portion of the back strap. Cord locks of this type are not strictly required and other types of cord locks may be used in other embodiments, such as those disclosed in U.S. Pat. Nos. 9,265,294 and 10,259,167 to Ellis et al. Here too the latter types of cord locks are not strictly required.

Referring to FIG. 2, cord locks 120 and 122 couple to respective sides 48 and 50 of bib 42 between top 44 of the bib and bottom 46 of the bib. The cord locks align and extend parallel with respective sides of the bib. Cord locks 120 and 122 are positioned within respective upper side hems 69 and 73 in this example. Each cord lock receives a respective end portion of back strap 102 therethrough via in this example a pair of spaced-apart eyelets coupled to its respective upper side hem: this is shown by cord lock 120 receiving end portion 106 of back strap 102 therethrough via a pair of spaced-apart eyelets 124 and 126 coupled to its respective upper side hem 69. End portions 106 and 110 of the back strap thus extend through respective ones of cord locks 120 and 122. As mentioned the cord locks are biased to inhibit movement of the strap therethrough. Each cord lock 120 includes an actuator, in this example a push-activated actuator 128 actuation of which selectively enables end portion 106 of back strap 102 to pass therethrough.

Cord locks 120 and 122 are configured to enable the extent to which back strap 102 extends between sides 48 and 50 of bib 42, namely, length L of sub-portions 116 and 118 of the strap, to be adjusted. Adjustment of one or more of the cord locks enables the size of second loop 112 to be selectively adjustable.

Coupling member 114 self-centers when bib 42 is in use: the coupling member remains centered relative to sides 48 and 50 of the bib and aligned with axis 43 of bib 42 as seen in FIG. 11 regardless of the extent to which the straps are adjusted. Still referring to FIG. 11, the extent to which sub-portions 116 and 118 of back strap 102 extend inwards and upwards, as shown by angles θ, varies as the back strap is adjusted. Angles θ remain substantially equal to each other through adjustment of the back strap in this example. Self-adjusting strap load equalizing system 78 is thus configured to promote even distribution of the weight of apron 40 across back 130 of a wearer, in this example person 132. The self-adjusting strap load equalizing system so shaped and configured may inhibit shoulders 134 of the person from being subjected to relatively large and/or unbalance forces thereon.

Figure 3:
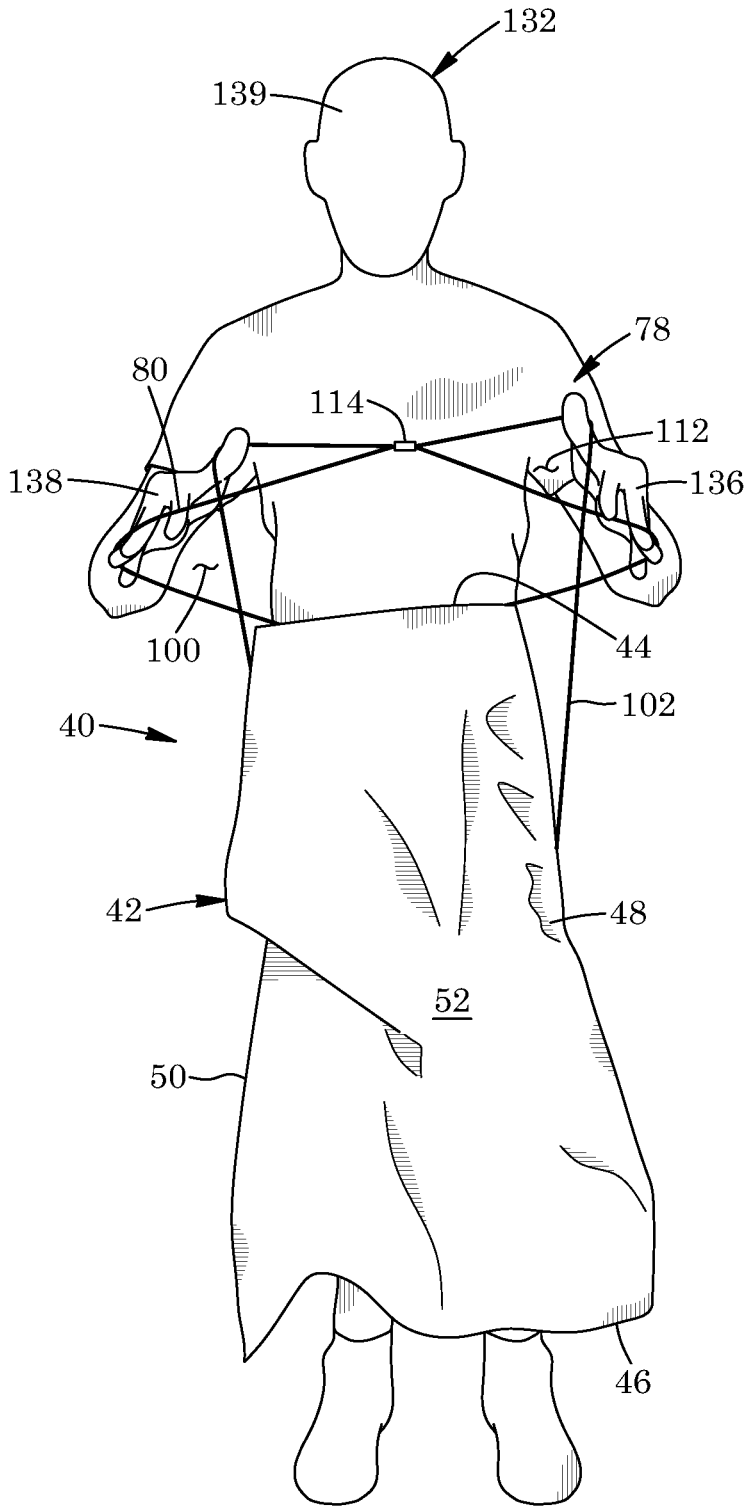
FIG. 3 is a front perspective view of the apron of FIG. 1 together with a person in the process of donning the apron, with a neck-yoke strap and a back strap of the self-adjusting strap load equalizing system being shown held and separated in a spread out manner by the person.
Figure 5:
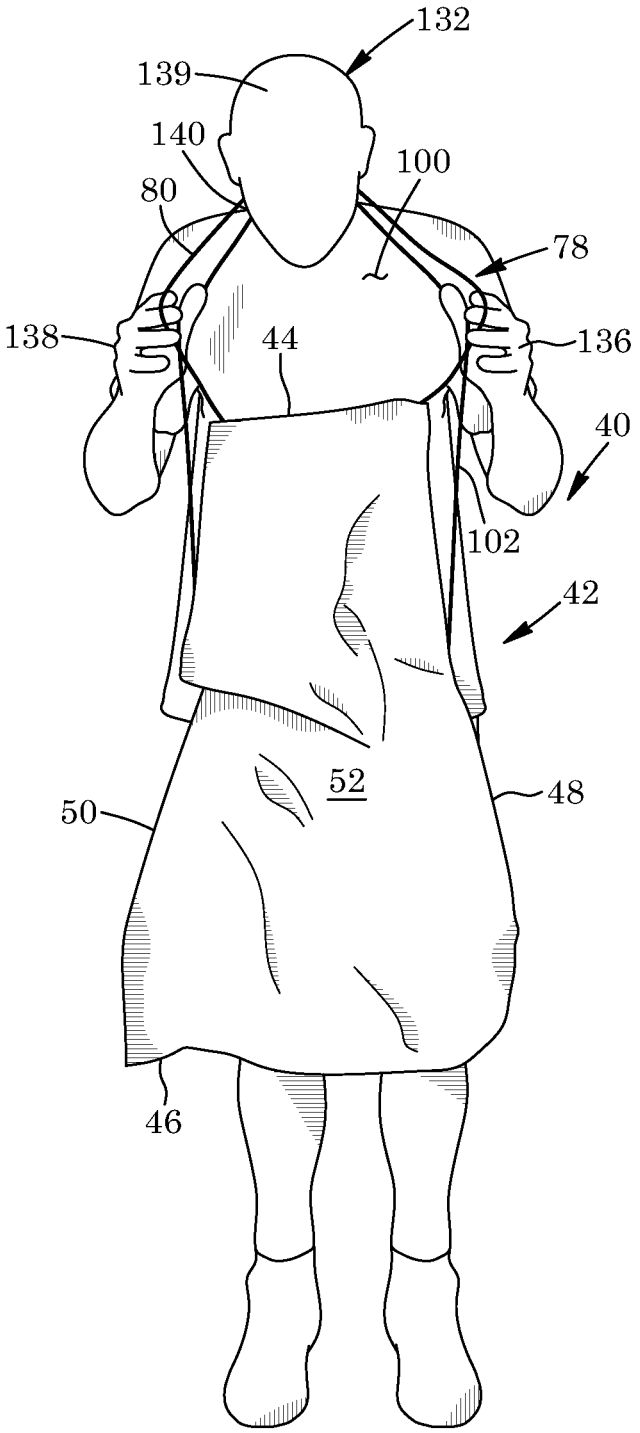
FIG. 5 is a front perspective view of the apron and person of FIG. 3, with the neck-yoke strap shown extending about the person's neck, and with the back strap being held and separated by the person.
Figure 6:
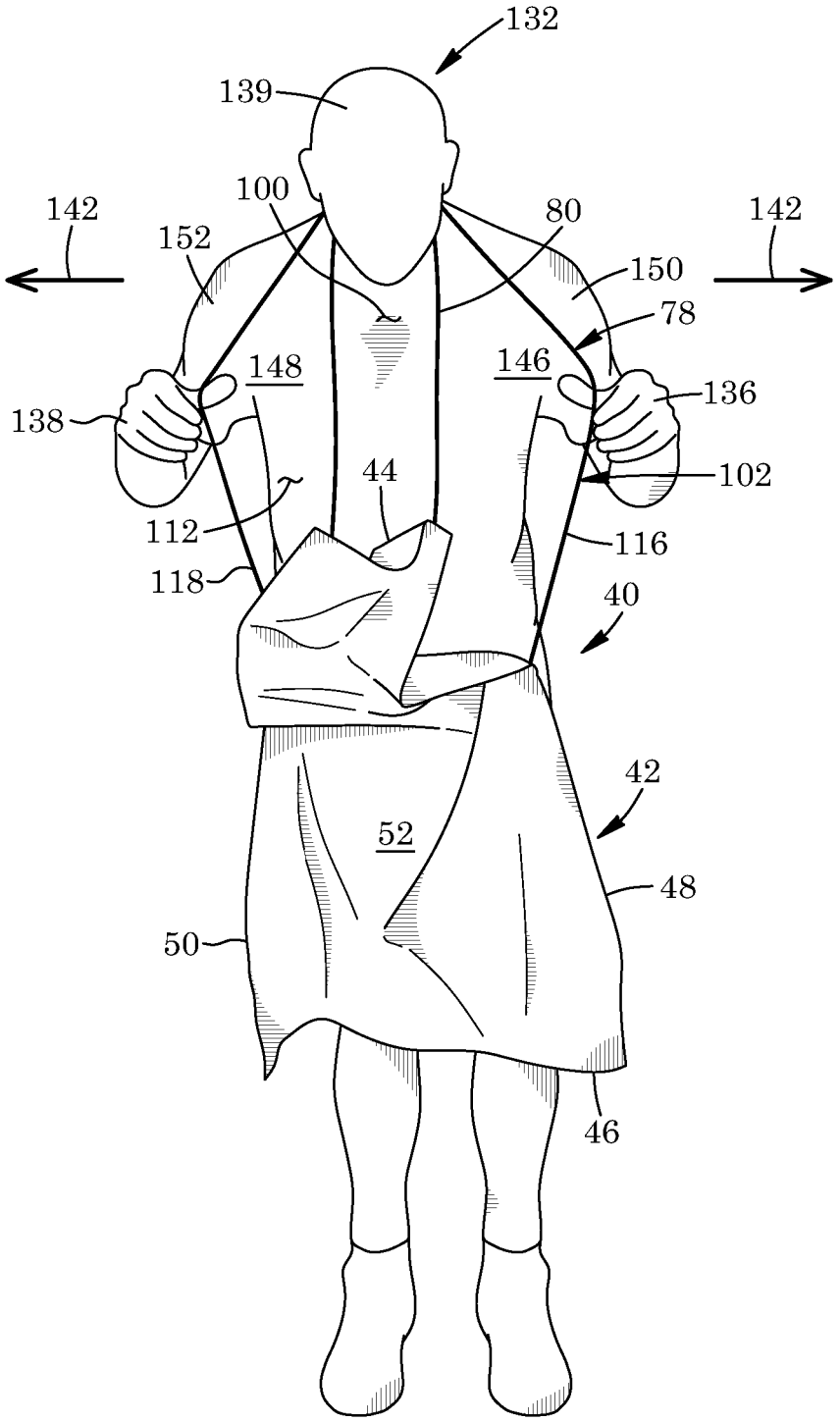
FIG. 6 is a front perspective view of the apron and person of FIG. 5, with the person shown in the process of pulling spaced-apart portions of the back strap outwards so as to form a loop through which to extend the person's arms.
Figure 7:
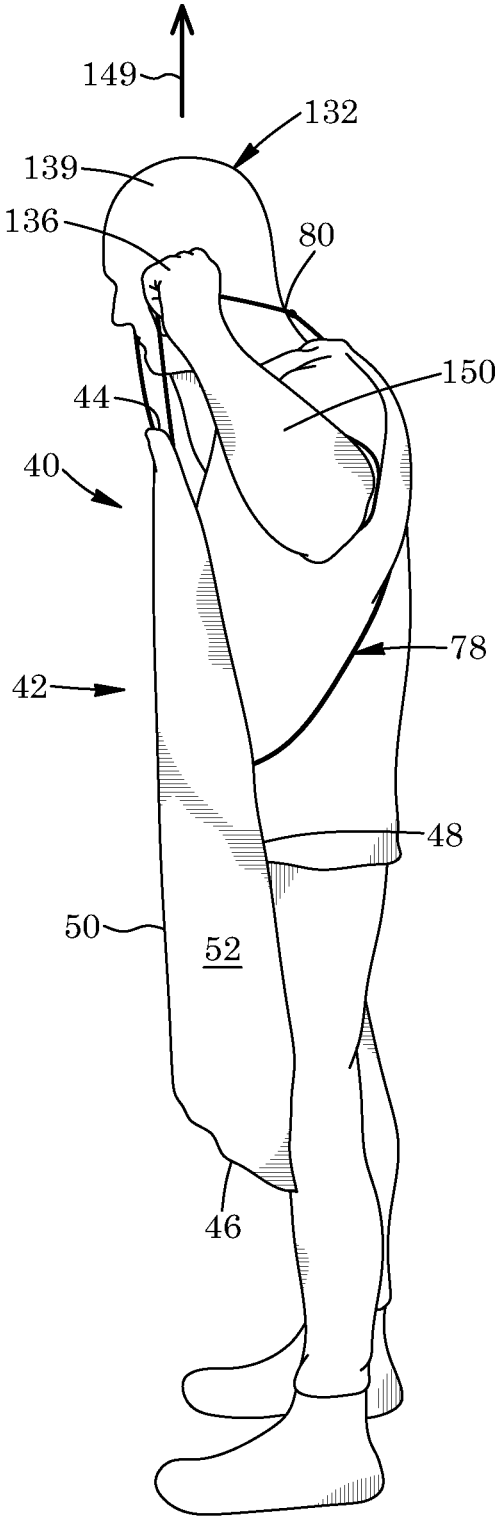
FIG. 7 is a left side perspective view of the apron and person of FIG. 6, with the arms of the person shown extending through the loop, with the back strap shown positioned in place about the lower back of the person, and with the person holding the apron upwards via the neck-yoke strap.
Figure 8:
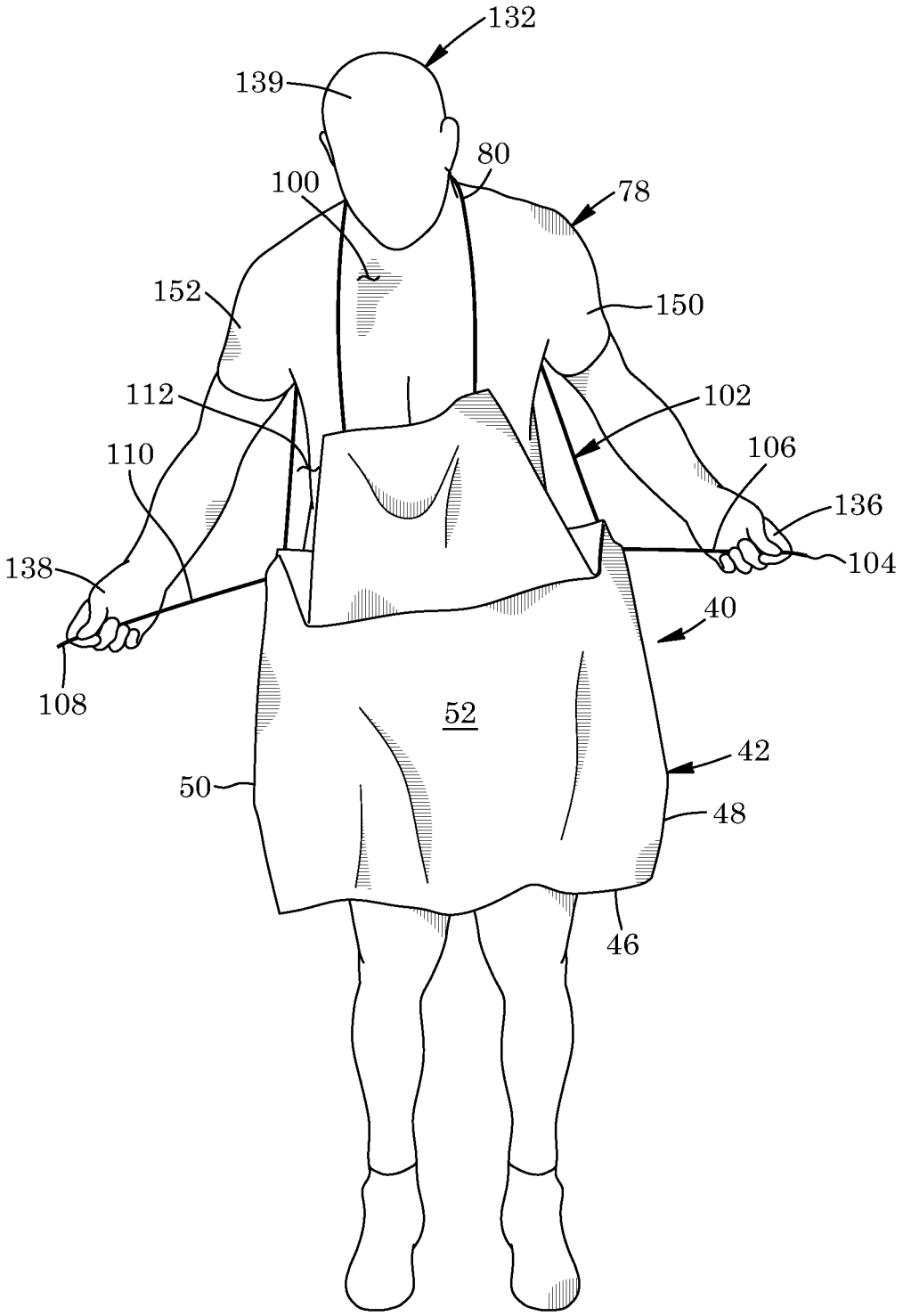
FIG. 8 is a front perspective view of the apron and person of FIG. 7 with the person gripping spaced-apart end portions of back strap.

In order to don apron 40 and referring to FIG. 3, person 132 may first hold straps 80 and 102 in hands 136 and 138 thereof and spread out loops 100 and 112. Loops 100 and 112 so spread out may then be extended over top of the person's head and rest on the person's neck 140 as seen in FIG. 5. Referring to FIG. 6, sub-portions 116 and 118 of neck-yoke strap 80 may then be extended outwards in opposed directions 142 and 144 so as to form sub-loops 146 and 148 formed by the sub-portions and the neck-yoke strap. The sub-loops may next raised upwards in direction 149 seen in FIG. 7. Arms 150 and 152 of person 132 may then be extended through the sub-loops, as seen in FIG. 8.

Figure 9:
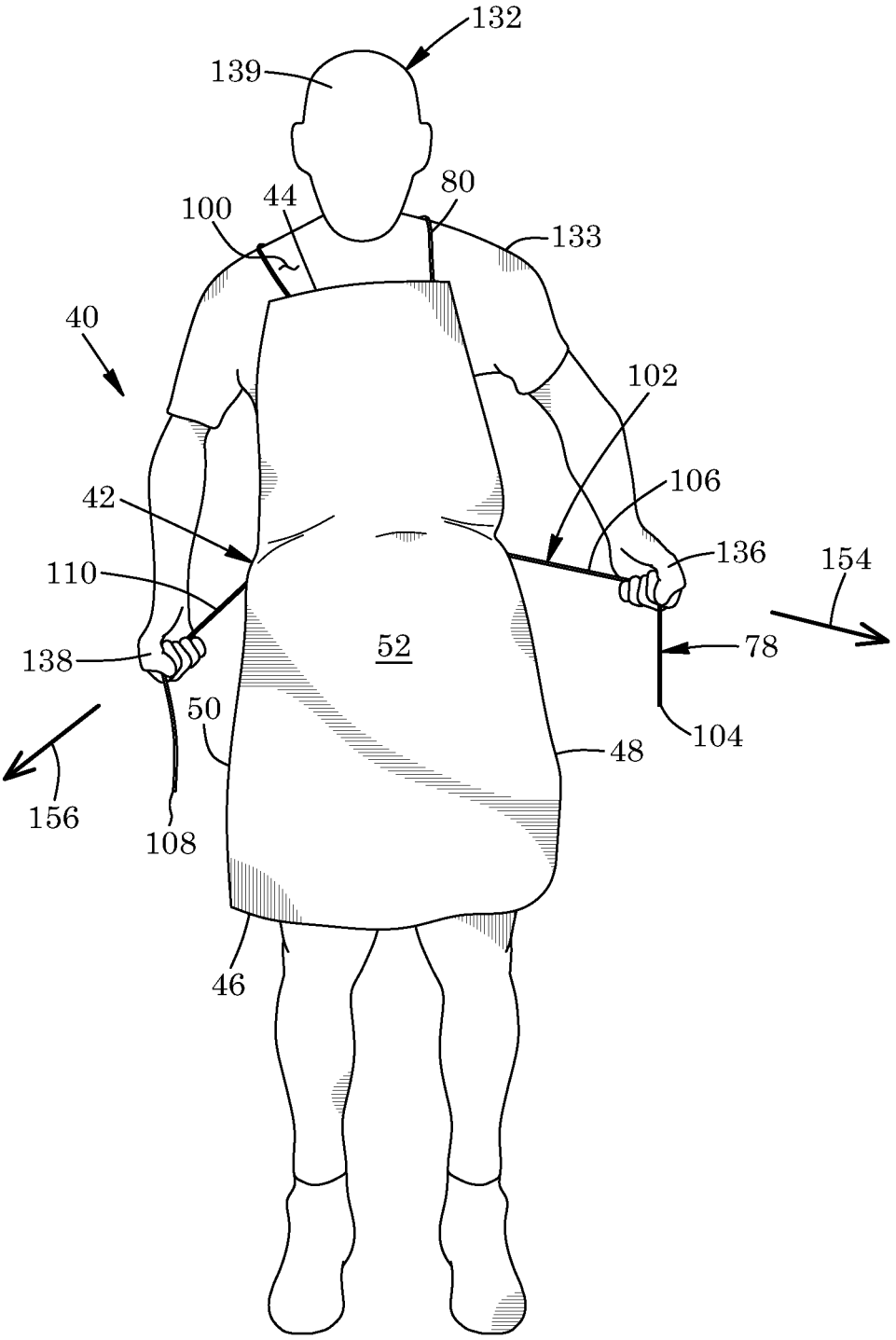
FIG. 9 is a front perspective view of the apron and person of FIG. 8, with the person adjusting the apron in place by pulling on the end portions of the back strap so as to reduce the size of the loop and cause the apron to abut in place along the front of the person and partially along the sides of the person thereby.
Figure 10:
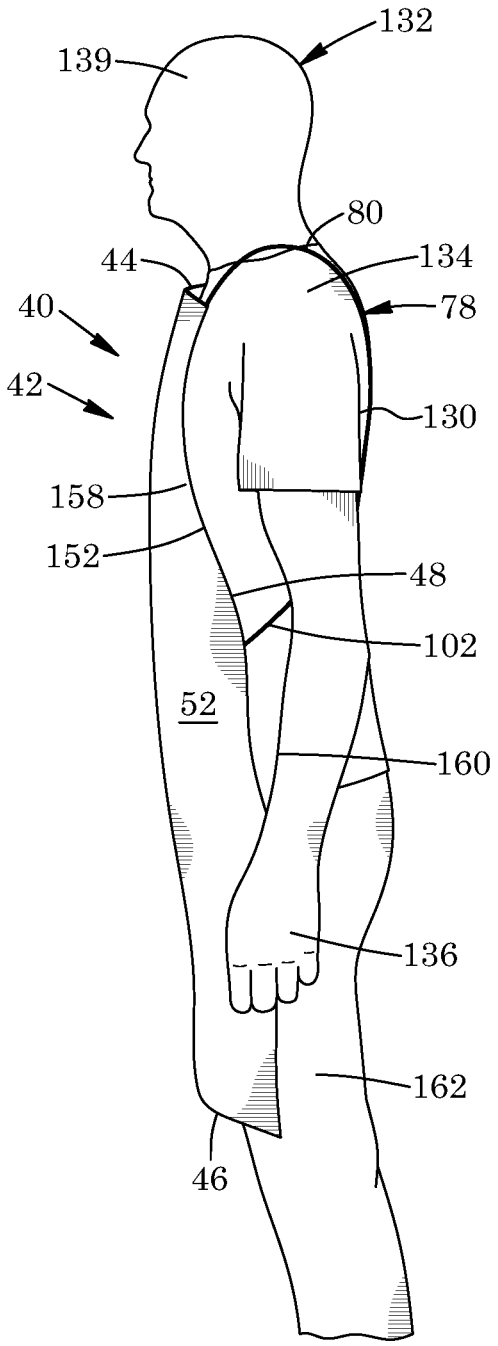
FIG. 10 is a left side perspective view of the apron and person of FIG. 9, with the apron shown coupled to the person and adjusted in place.

End portions 106 and 110 of back strap 102 are next gripped and pulled by person 132 downwards and/or outwards, as seen by arrows 154 and 156 in FIG. 9. This reduces length L of sub-portions 116 and 118 of back strap 102 seen in FIG. 2 and thus tightens apron 40 about person 132. Referring to FIG. 10, bib 42 so tightened abuts and rests snugly against front 158 and partially along sides 160 of person 132 by legs 162 of the person in this example. The bib is shaped in use to thus substantially keep the sides and rear of the person's torso free thereof in this example. As seen in FIG. 11, coupling member 114 aligns along the center of back 130 of the person when the bib is in use and so positioned in place. The coupling member is centered between top 44, bottom 46 and sides 48 and 50 of bib 42 when in use and so positioned in place.

Figure 4:
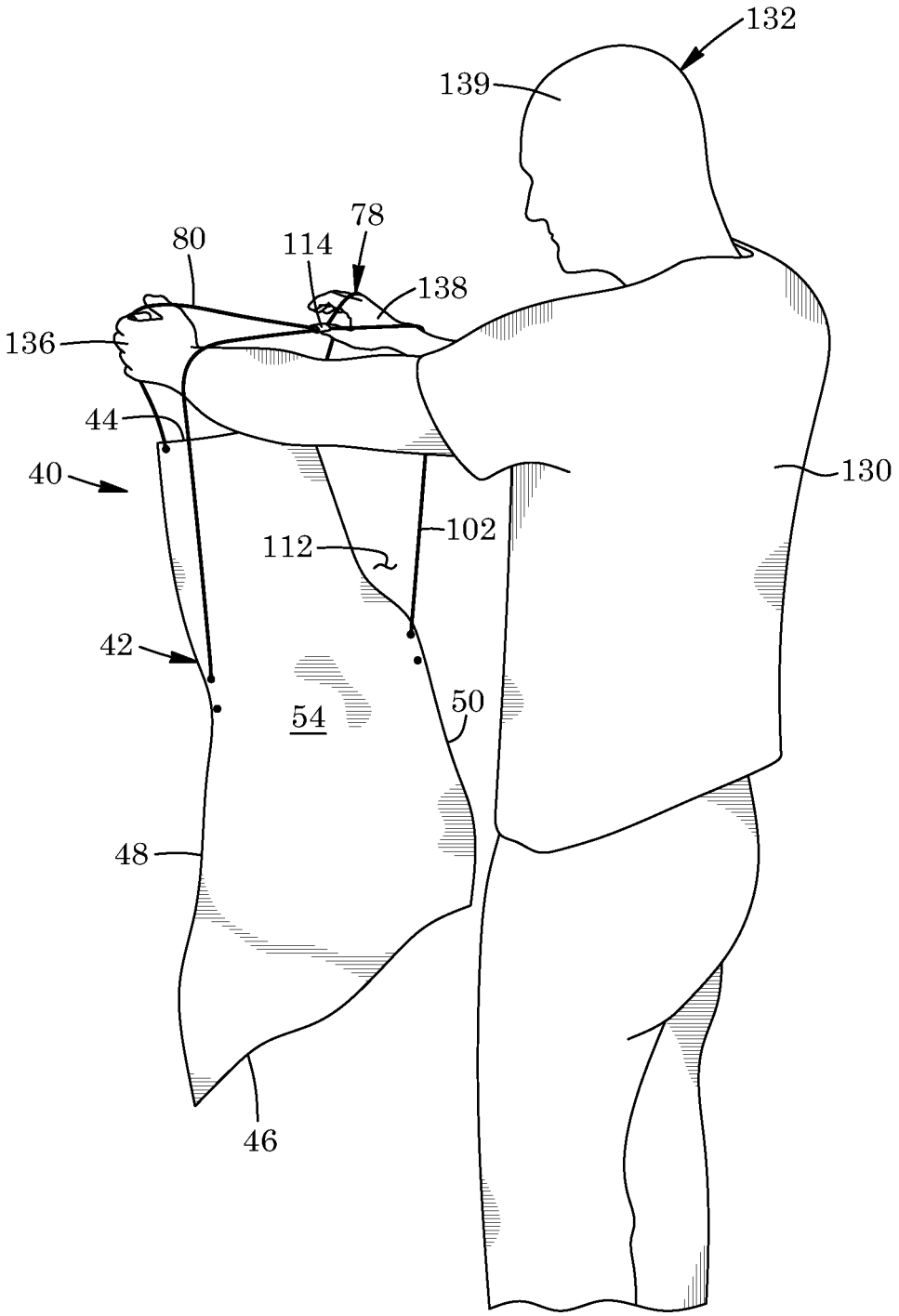
FIG. 4 is a left side, rear perspective view thereof.
Figure 12:
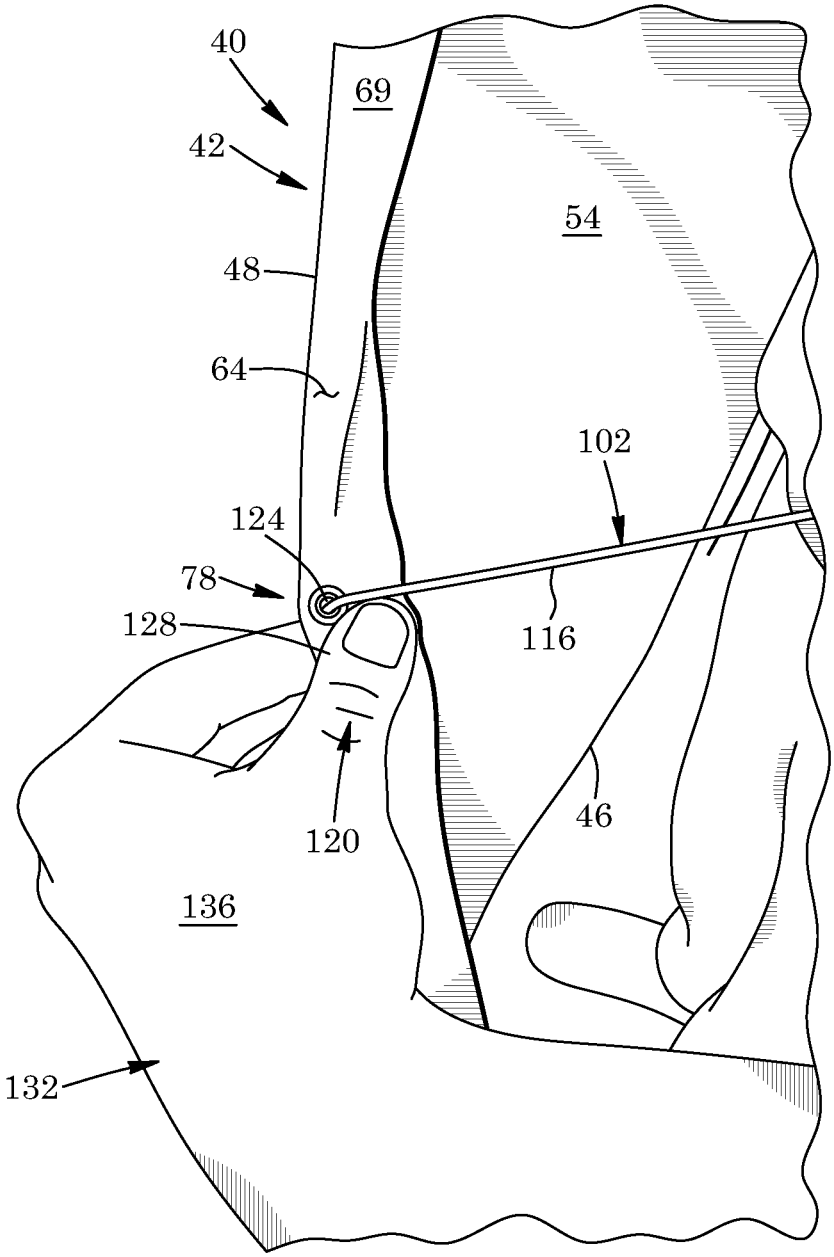
FIG. 12 is a rear, left side perspective view of the apron of FIG. 9 together with the person of FIG. 9 shown in fragment and in the process of actuating one of the cord locks of the apron so as to enlarge the loop for doffing the apron.
Figure 13:
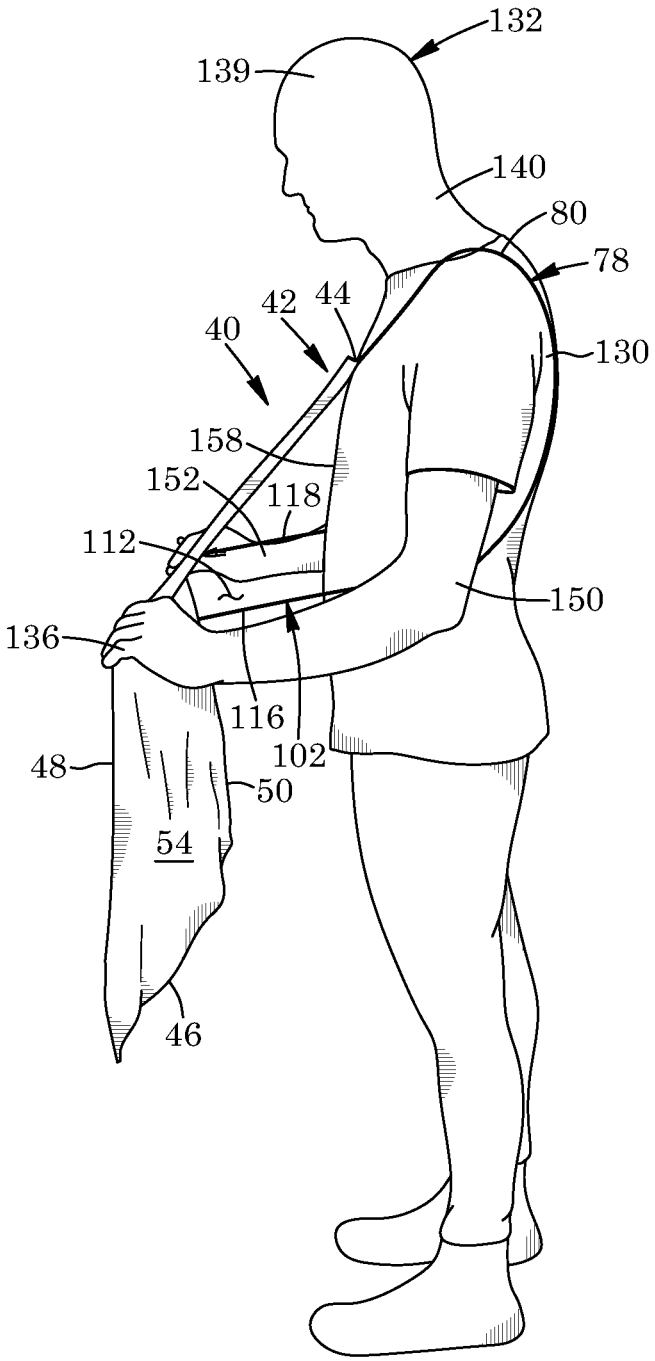
FIG. 13 is a left side perspective view of the apron and person of FIG. 12, with the person shown actuating the cord locks and with the loop shown in an enlarged state for thereafter removing the apron.
Figure 14:
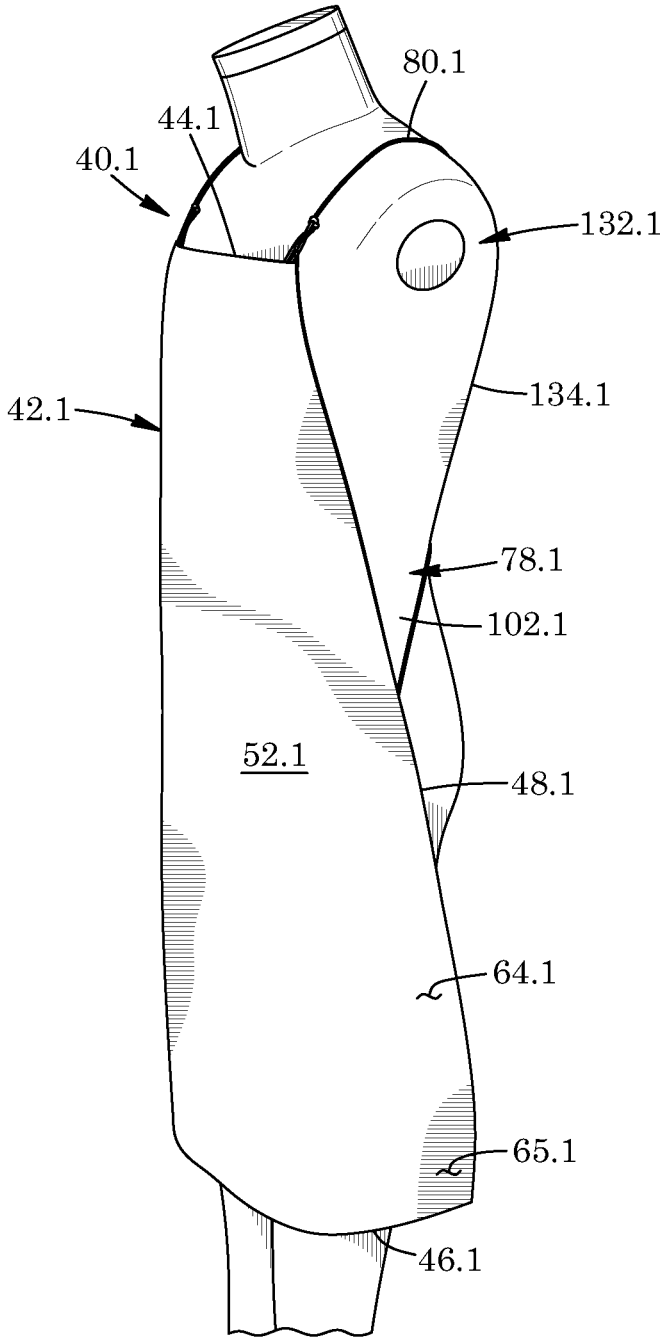
FIG. 14 is a front, left side perspective view of an apron according to a second aspect, the apron including a self-adjusting strap load equalizing system and being shown extending about a mannequin.
Figure 15:
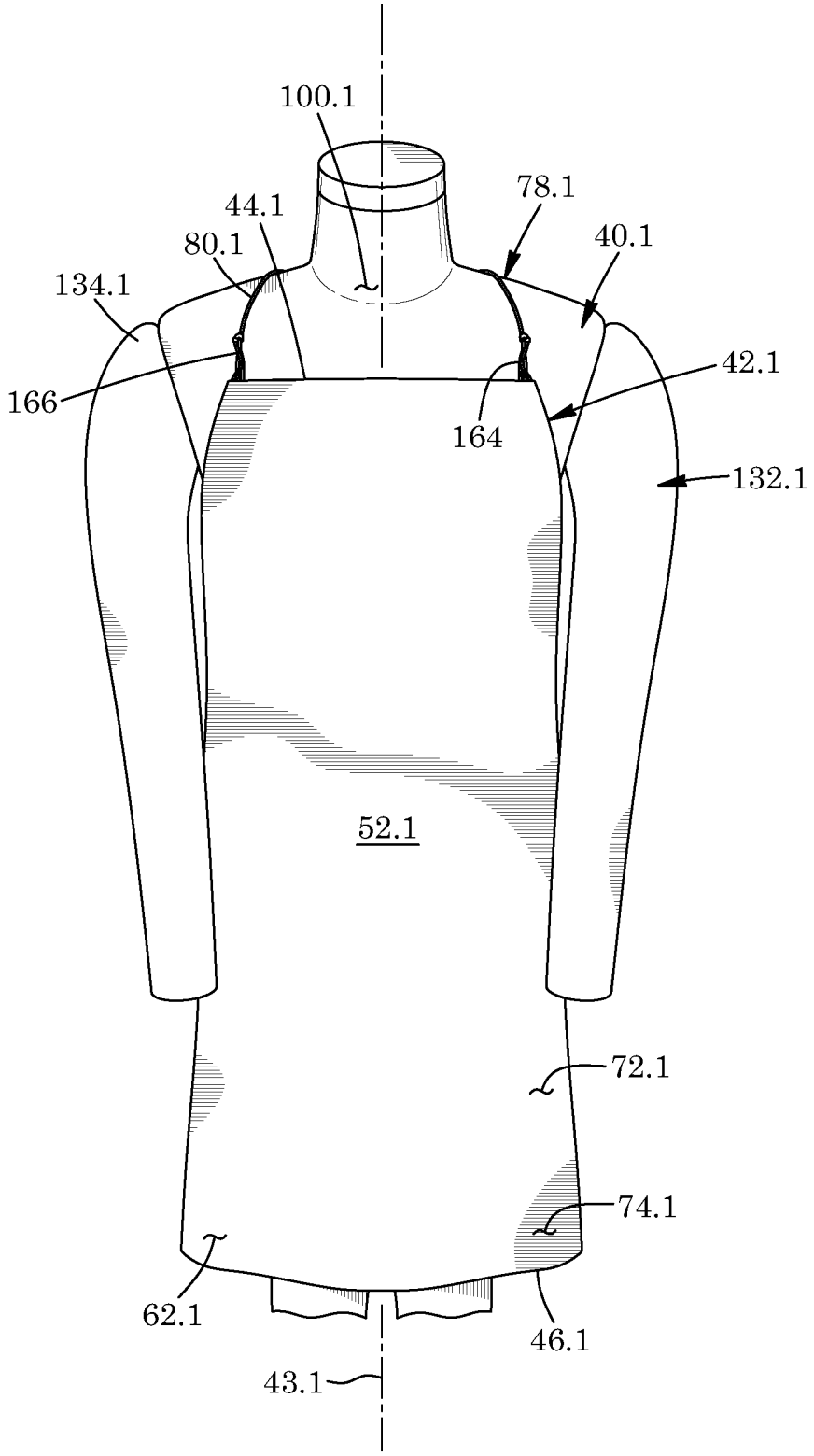
FIG. 15 is a front perspective view thereof.

To remove the bib and referring to FIG. 12, push cord locks 120 are actuated by pressing inwards on push-activated actuators 128 via hands 136 of person 132. As seen in FIG. 2B, this may involve the person squeezing together tubular bodies 121 and 125. This releases back strap 102 from the clamping action of cord lock 120 and enables person 132 to thereafter extend bib 42 outwards from front 158 of the person as seen in FIG. 13, with sub-portions 116 and 118 of the back strap lengthening thereby. The sub-portions of the back strap so lengthened create enlarged sub-loops 146 and 148 seen in FIG. 6, facilitate the removal of the person's arms 150 and 152 from the back strap and facilitate removal of neck-yoke strap 80 from the person's neck 140 seen in FIG. 4.

FIGS. 14 to 19 show an apron 40.1 and self-adjusting strap load equalizing system 78.1 according to a second aspect. Like parts have like numbers and functions as apron 40 and self-adjusting strap load equalizing system 78 shown in FIGS. 1 to 13 with the addition of decimal extension ".1". Apron 40.1 and self-adjusting strap load equalizing system 78.1 are substantially the same as apron 40 and self-adjusting strap load equalizing system 78 shown in FIGS. 1 to 13 with the following exceptions.

Figure 16:
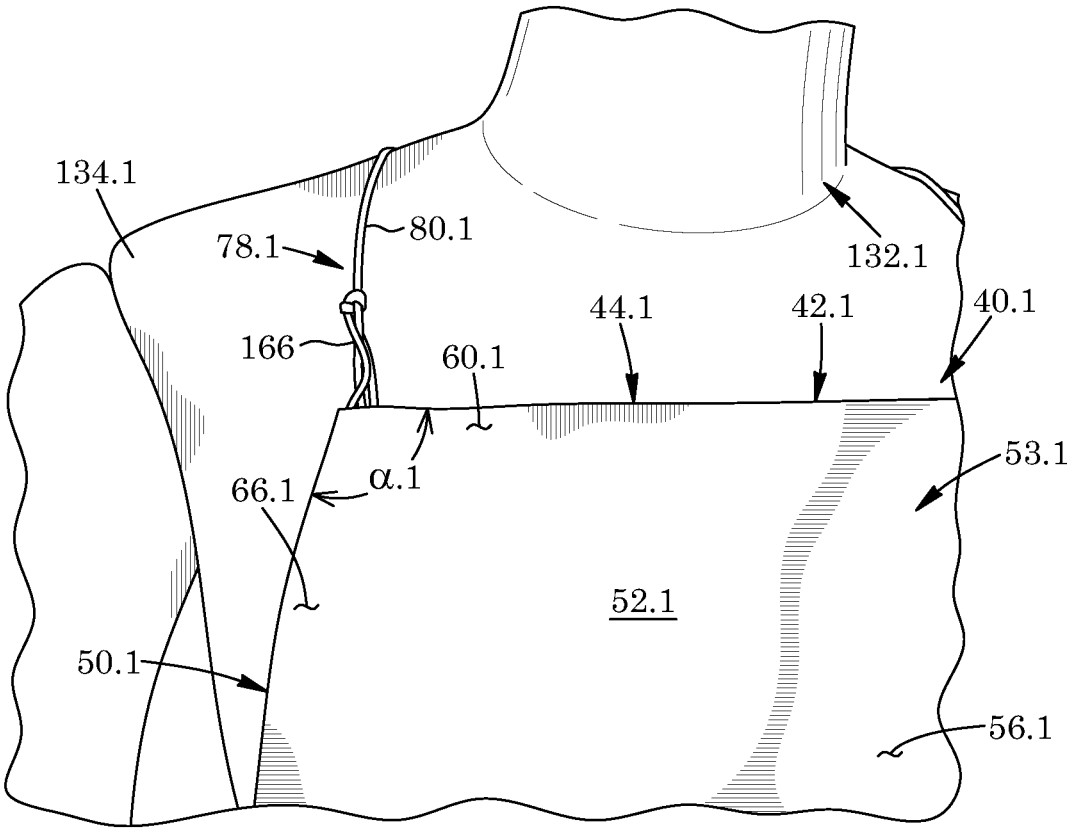
FIG. 16 is an enlarged front perspective view of an upper portion of a bib of the apron of FIG. 14 together with a neck-yoke strap of the system, with the apron and system thereof shown in fragment, and with the mannequin of FIG. 14 shown in fragment.
Figure 17:
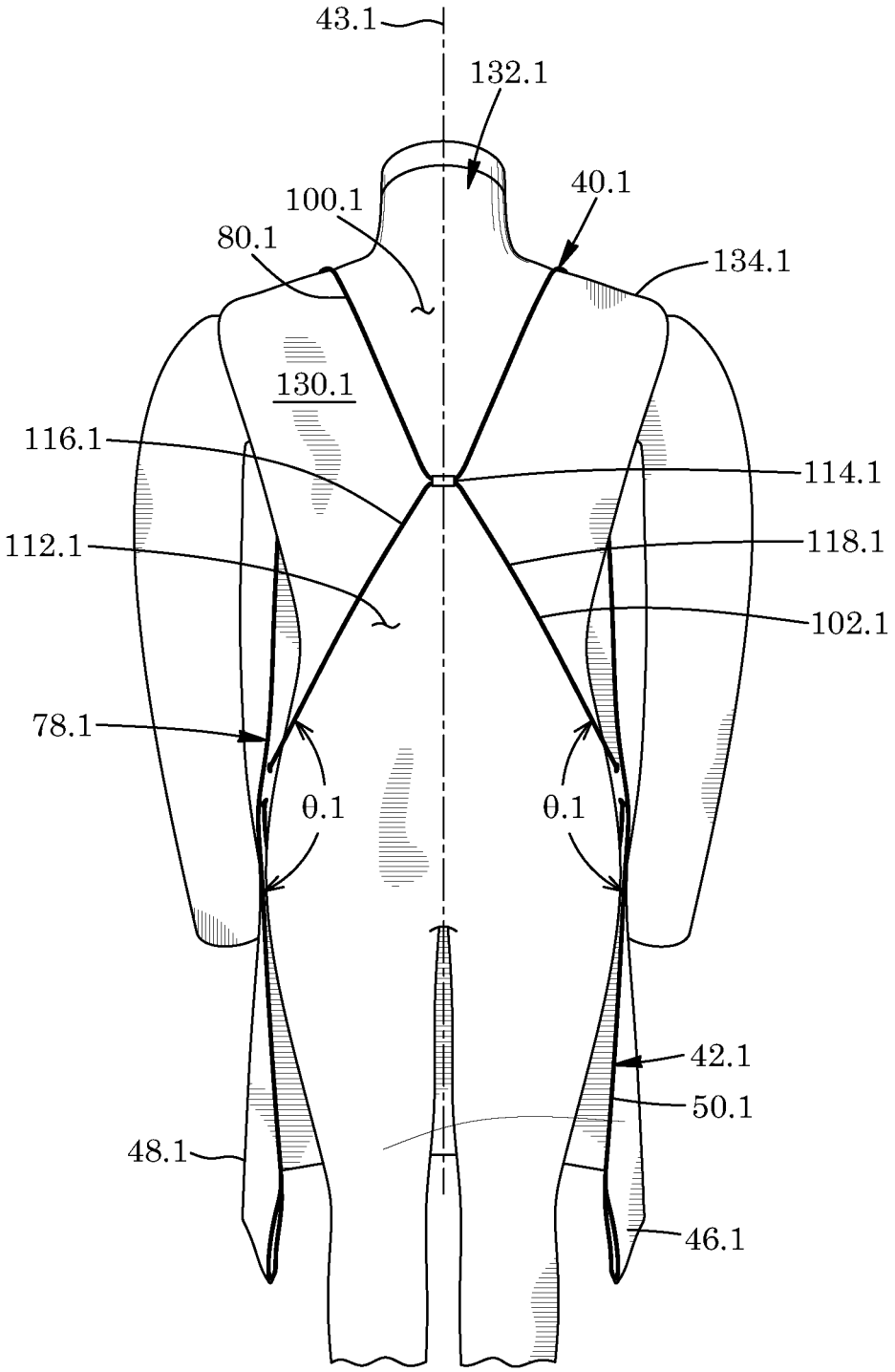
FIG. 17 is a rear perspective view of the apron and mannequin of FIG. 14.

Apron 40.1 is shown on a wearer in the form of a mannequin 132.1. As seen in FIG. 16, end portions 82.1 and 84.1 of neck-yoke strap 80.1 couple to top 44.1 of bib 42.1 via a pair of spaced-apart loops 164 and 166 in this embodiment; however, this is not strictly required. The loops are positioned adjacent respective corners 94.1 of the bib in this example.

Figure 18:
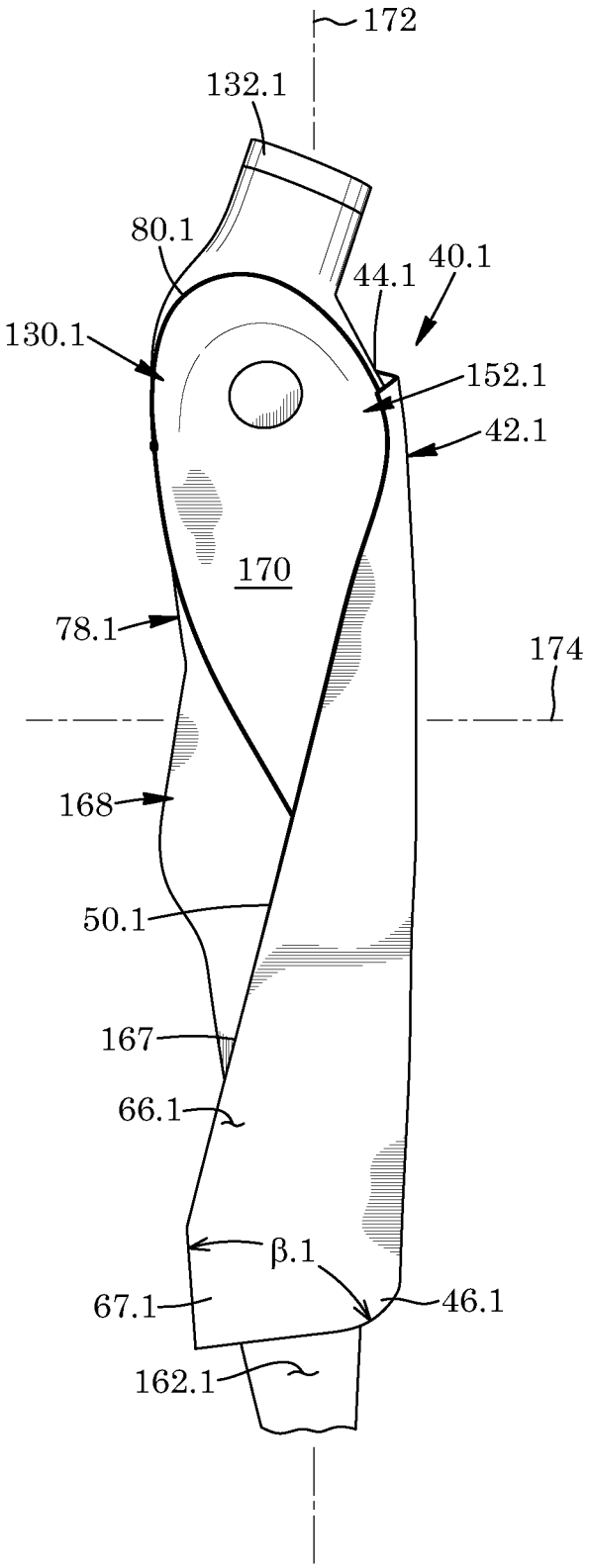
FIG. 18 is a right side perspective view thereof.
Figure 19:
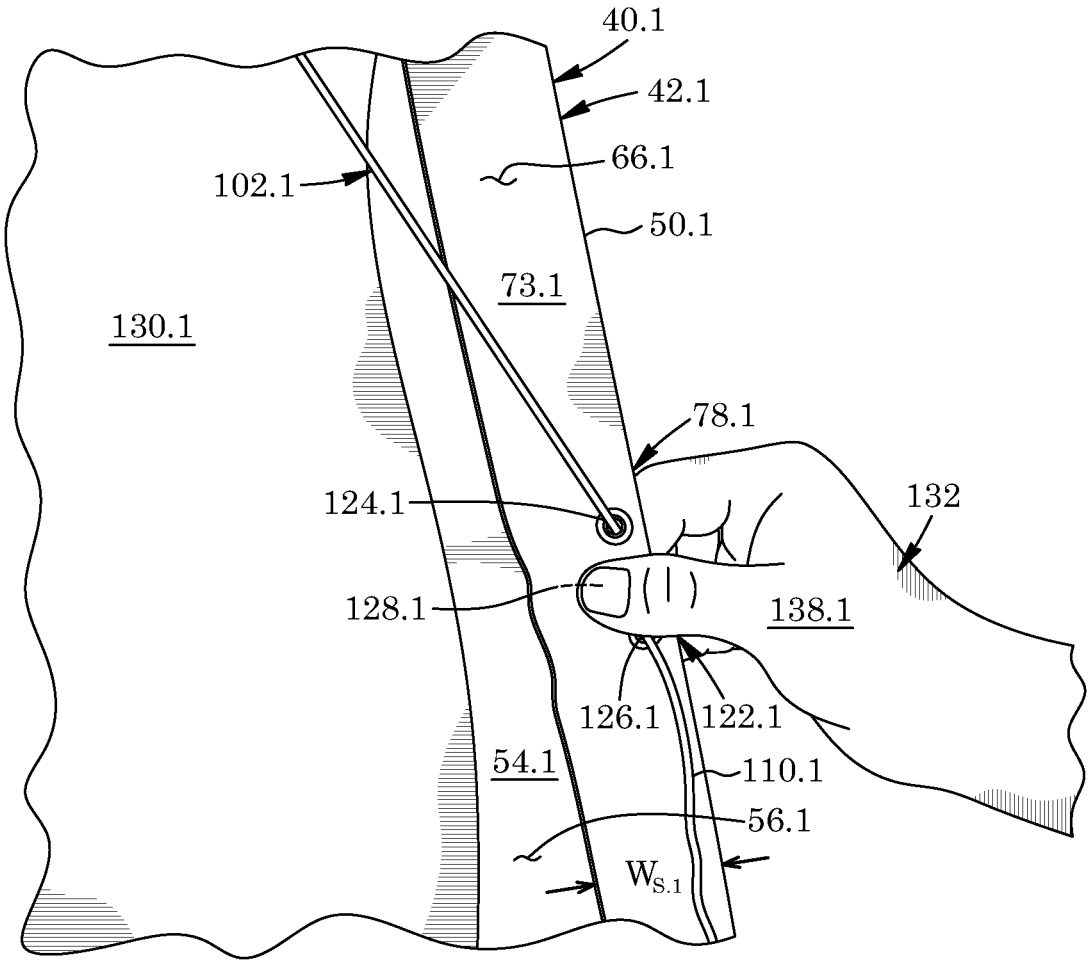
FIG. 19 is an enlarged rear perspective view of the apron and mannequin of FIG. 14 shown in fragment, with a cord lock of the apron positioned within a hem of the apron and being shown in the process of being actuated by a person's hand.

As seen in FIG. 18, lower side peripheral portions 67.1 of bib 42.1 extend upwards from and substantially perpendicular to bottom 46.1 of the bib, with angles β being approximately equal to 90 degrees in this example.

Still referring to FIG. 18, the bib is shaped such that the lower side peripheral portions thereof extend across the sides of upper portion 167 of legs 162.1 and to rear 168 of mannequin 132.1. Upper side peripheral portions 66.1 of bib 42.1 extend diagonally along sides 170 of the mannequin relative to longitudinal axis 172 of the mannequin and lateral axis 174 of the mannequin, from the front towards the rear of the mannequin. Bib 42.1 in use is thus generally triangular in shape in side profile in this example; however, this is not strictly required.

Figure 20:
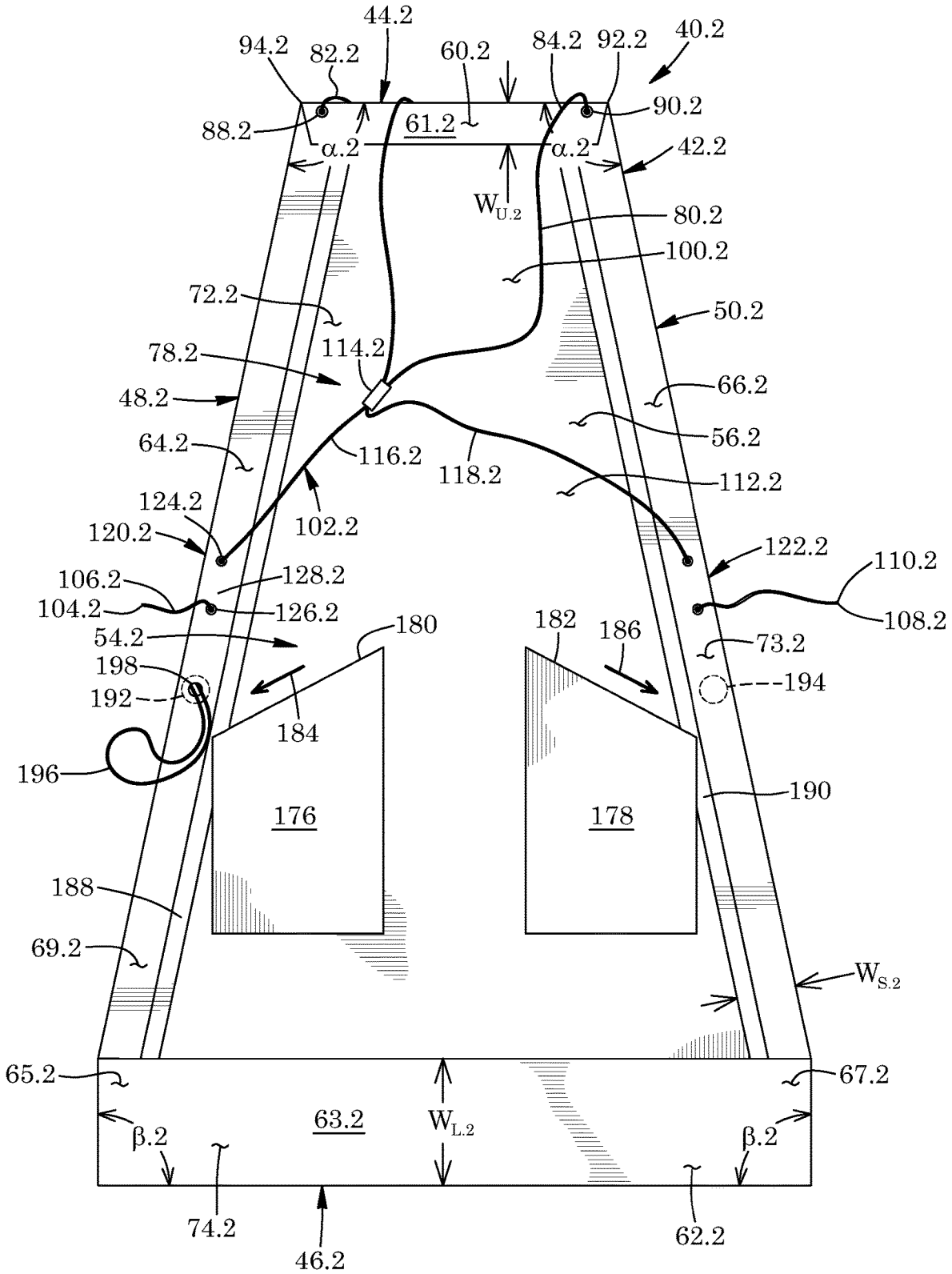
FIG. 20 is a rear elevation view of an apron according to a third aspect.

FIG. 20 shows an apron 40.2 and self-adjusting strap load equalizing system 78.2 according to a third aspect. Like parts have like numbers and functions as the apron 40 and self-adjusting strap load equalizing system 78 shown in FIGS. 1 to 13 with the addition of decimal extension ".2". Apron 40.2 and self-adjusting strap load equalizing system 78.2 are substantially the same as apron 40 and self-adjusting strap load equalizing system 78 shown in FIGS. 1 to 13 with the following exceptions.

Apron 40.2 includes at least one and in this example a pair of pockets 176 and 178. The pockets couple to inner side 54.2 of bib 42.2. Pockets 176 and 178 are positioned in this example within inner portion 56.2 of the bib. The pockets have open tops 180 and 182. The open tops of pockets 176 and 178 extend diagonally downwards from directions 184 and 186, respectively, which extend from longitudinal axis 43.2 of the bib towards sides 48.2 and 50.2 of the bib, respectively. The pockets are positioned to extend along and abut the front/side of the person wearing apron 40.2, with the pockets thus being configured to remain hidden when bib 42.2 is in use.

The bib includes a pair of spaced-apart lining strips 188 and 190 extending along, adjacent to and coupled to upper side hems 69.2 and 73.2. The lining strips extend diagonally when the bib is in use in this example.

Apron 40.2 includes one or more magnetics, in this example a pair of magnets 192 and 194. The magnets couple to upper side peripheral portions 64.2 and 66.2 of bib 42.2, respectively. Magnets 192 and 194 are positioned within upper side hems 69.2 and 73.2 in this example. The magnets are thus embedded within bib 42.2. Magnets 192 and 194 are shaped to enable objects, such as strap 196 with a ferromagnetic end 198, to selectively removably couple thereto and/or hang downwards therefrom. Apron 40.2 so configured thus enables the hanging of towels and other quick-need items therefrom.

Aprons 40/40.1/40.2 as herein described may provide numerous advantages. Coupling member 114/114.1/114.2 may be comprise a ring/tube like fixture that may tram along the straps, bridging straps 80/80.1/80.2 and 102/102.1/102.2 to effectively unite the straps, affording self-adjusting strap load equalizing system 80/80.1/80.2 to distribute the weight of the apron evenly across the wearers back. This may result in little force experienced on the shoulders and promote the experience of apron 40/40.1/40.2 floating on the wearer. The aprons as herein described with their straps 80/80.1/80.2 and 102/102.1/102.2 in this configuration, have adjustable sizing through the cord-locks 120/120.1/120.2 and 122/122.1/122.2 on and/or adjacent sides 48/48.1/48.2 and 50/50.1/50.2 of the apron. Aprons 40/40.1/40.2 as herein described may be said to comprise bib 42/42.1/42.2 that is hemmed in with an adjustable length mechanism installed internally on the hem, thereby resulting in a clean look and an adjustment mechanism that may be less likely to be damaged. The corner seams at the upper and lower hems may result a unique and pleasing aesthetic. The hem construction using adhesive, in this example in the form of thermo-adhesive film 76 seen in FIG. 2A, with the thermo-adhesive film positioned to protrude from hem 69 to create a glue wedge, may result in an apron 40 that is more robust.

Where a component (e.g. an apparatus, assembly, device, member etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms. These terms ("a", "an", and "the") mean one or more unless stated otherwise;
- "and/or" is used to indicate one or both stated cases may occur, for example A and/or B includes both (A and B) and (A or B);
- "approximately" when applied to a numerical value means the numerical value±10%;
- where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and
- "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

Additional Description

Examples of aprons and adjustment mechanisms therefor have been described. The following clauses are offered as further description.

(1) An apron comprising: a bib having a top and spaced-apart sides; a first strap having a pair of spaced-apart ends which couple to and extend outwards from the top of the bib; a second strap which couples to and extends between the sides of the bib; and a coupling member positioned between the sides of the bib, the coupling member slidably coupling together the first strap and the second strap.

(2) An apron comprising: a bib; a first strap and a second strap, the bib and the first strap forming a first loop, and the bib and the second strap forming a second loop; and a coupling member via which the first loop and the second loop slidably couple.

(3) An apron comprising: a bib having a top and spaced-apart sides; and a self-adjusting strap load equalizing system including a neck-yoke strap, a back strap, and a coupling member which slidably couples together the straps.

(4) An apron according to any preceding or subsequent clause, wherein the self-adjusting strap load equalizing system is configured to promote even distribution of the weight of the apron across one's back, thereby inhibiting force experienced on one's shoulders.

(5) An apron according to any preceding or subsequent clause, wherein the coupling member is a sleeve.

(6) An apron according to any preceding or subsequent clause, wherein the coupling member is tubular.

(7) An apron according to any preceding or subsequent clause, wherein a first said end of the first strap couples to the bib adjacent to a first said side of the bib and wherein a second said end of the first strap couples to the bib adjacent to a second said side of the bib.

(8) An apron according to any preceding or subsequent clause, wherein the second strap has spaced-apart first and second ends, and wherein a first said end of the first strap aligns with the first end of the second strap and a second said end of the first strap aligns with the second end of the second strap.

(9) An apron according to any preceding or subsequent clause, wherein the bib includes an upper portion which is an isosceles trapezoid in shape and a lower portion which is an inverted isosceles trapezoid in shape.

(10) An apron according to any preceding or subsequent clause, wherein the bottom of the bib is wider than the top of the bib, wherein the sides of the bib include lower side peripheral portions which couple to the bottom of the bib and which flare in a direction extending from the bottom towards the top of the bib, and wherein the sides of the bib include upper side peripheral portions which couple to the top of the bib and taper in a direction extending from the top of the bib towards the bottom of the bib.

(11) An apron according to any preceding or subsequent clause, further including at least one strap adjustment mechanism configured to enable the extent to which the second strap extends between the sides of the bib to be adjusted.

(12) An apron according to clause 11, or any preceding or subsequent clause, where in the adjustment mechanism couples to one said side of the bib between the top of the bib and the bottom of the bib.

(13) An apron according to clause 2, or any preceding or subsequent clause, further including a pair of spaced-apart strap adjustment mechanisms coupled to the bib and via which the size of said second loop is selectively adjustable.

(14) An apron according to any preceding or subsequent clause, further including a pair of cord locks coupled to the sides of the bib, with end portions of the second strap extending respectively therethrough.

(15) An apron according to any preceding or subsequent clause, wherein the top and the sides of the bib include hems and wherein the straps couple to and extend from said hems.

(16) An apron according to clause 14, or any preceding or subsequent clause, wherein each said side of the bib includes a hem and wherein the cord locks couple to and are disposed at least in part within said hems.

(17) An apron according to clause 14, or any preceding or subsequent clause, wherein the cord locks align and extend parallel with respective said sides of the bib.

(18) An apron according to any preceding or subsequent clause, wherein the second strap has a first sub-portion which extends from a first said side of the bib to the coupling member at a first angle relative to the first said side of the bib, wherein the second strap has a second sub-portion which extends from a second said side of the bib to the coupling member at a second angle relative to the second said side of the bib, the first angle being substantially equal to the second angle, said angles varying as the second strap is adjusted and remaining substantially equal to each other through adjustment of said second strap.

(19) An apron according to any preceding or subsequent clause, wherein the coupling member self-centers.

(20) An apron according to any preceding or subsequent clause, wherein the coupling member is configured to remain centered relative to the sides of the bib regardless of the extent to which the straps are adjusted.

(21) An apron according to any preceding or subsequent clause, wherein the first strap has a non-adjustable fixed length.

(22) An apron according to any preceding or subsequent clause, wherein each said side of the bib extends from the top of the bib at an obtuse angle relative to the top of the bib, and wherein each said side of the bib extends from the bottom of the bib at an obtuse angle relative to the bottom of the bib.

(23) An apron according to any preceding or subsequent clause, wherein the bib has an exterior surface which faces outwards and an interior surface opposite the exterior surface, and wherein the apron further includes one or more pockets coupled to the interior surface of the bib.

(24) An apron according to any preceding or subsequent clause, wherein the bib includes an inner portion, a peripheral portion which extends about said inner portion, and a lining coupled to, coplanar with and extending along said inner portion.

(25) An apron according to any preceding or subsequent clause, wherein the front of the bib is seamless and free of stitching.

(26) An apron according to any preceding or subsequent clause, wherein the bib has an exterior surface which faces outwards and an interior surface opposite the exterior surface, and wherein the straps couple to and extend from the interior surface of the bib, with no visible connection to the exterior surface of the bib.

(27) An apron according to clause 26, or any preceding or subsequent clause, wherein the straps are anchored to the hem on the inside of the apron.

(28) An apron according to any preceding or subsequent clause, wherein the hem is bonded to the interior surface of the apron with thermo-adhesive film.

(29) An apron according to any preceding or subsequent clause, wherein each said strap has a diameter equal to or less than 3 millimeters.

(30) An apron according to any preceding or subsequent clause, wherein each said strap comprises braided cord.

(31) An apron according to any preceding or subsequent clause, further including one or more magnetics embedded within the bib and to which objects selectively couple.

(32) An apron according to any preceding or subsequent clause, further including a lower hem which is wider than the side hems and the upper hem, the lower hem being shaped to promote tensioning outwards of the bib.

(33) An apron according to any preceding or subsequent clause, further including a lower hem which is wider than the side hems and the upper hem, the lower hem being shaped to promote flattening of the bib.

(34) An apron according to any preceding or subsequent clause, wherein the bib is an elongate hexagonal in shape.

(35) An apron according to any preceding or subsequent clause, wherein the bib is an isosceles trapezoid in shape with removed or folded-in bottom corners.

(36) An apron comprising: a bib including an upper hem and a pair of spaced-apart side hems; a pair of strap adjustment mechanisms positioned at least in part within the side hems of the bib; and a strap assembly including upper end portions that are anchored to and positioned within the upper hem of the bib and including lower end portions configured to extend through the strap adjustment mechanisms.

(37) An apron according to any preceding or subsequent clause, wherein the apron is a tie-free said apron.

(38) Apparatus including any new and inventive feature, combination of features, or sub-combination of features as described herein.

(39) Methods including any new and inventive steps, acts, combination of steps and/or acts or sub-combination of steps and/or acts as described herein.

It will be appreciated that many variations are possible within the scope of the invention described herein. It will also be understood by someone skilled in the art that many of the details provided above are by way of example only and are not intended to limit the scope of the invention which is to be determined with reference to at least the following claims.

What is claimed is:

1. An apron comprising:

a bib having a top and spaced-apart sides; and a self-adjusting strap load equalizing system including a neck-yoke strap, a back strap, and a coupling member which slidably couples together the neck-yoke strap and the back strap, wherein the coupling member is configured to self-center regardless of the extent to which the neck-yoke strap and the back strap are adjusted.

2. An apron according to claim 1, wherein the self-adjusting strap load equalizing system is configured to promote even distribution of the weight of the apron across one's back, thereby inhibiting force experienced on one's shoulders.

3. An apron according to claim 1, wherein the coupling member is conduit-shaped.

4. An apron according to claim 1, wherein the coupling member is tubular.

5. An apron according to claim 1, wherein the coupling member is a sleeve.

6. An apron according to claim 1, wherein the coupling member is slidable relative to the neck-yoke strap and wherein the coupling member is slidable relative to the back strap.

7. An apron according to claim 1, wherein the coupling member is positioned downwards from the top of the bib.

8. An apron comprising:

first and second straps, with the bib and the first strap forming a first loop and with the bib and the second strap forming a second loop; and a coupling member via which the first loop and the second loop slidably couple, wherein the coupling member is configured to self-center relative to the sides of the bib.

9. An apron according to claim 8, wherein the bib has a top and spaced-apart sides, wherein the first strap has a pair of spaced-apart ends which couple to and extend outwards from the top of the bib, and wherein the second strap couples to and extends between the spaced-apart sides of the bib.

10. An apron according to claim 8, wherein the coupling member is positioned between spaced-apart sides of the bib and wherein the coupling member is positioned between a top and a bottom of the bib.

11. An apron according to claim 8, wherein the apron is tie-free and includes a pair of spaced-apart strap adjustment mechanisms coupled to the bib and via which the size of said second loop is selectively adjustable.

12. An apron according to claim 8, wherein the coupling member slidably couples to the first strap such that the first loop extends outwards therefrom vertically in part and laterally therefrom in part and wherein the coupling member slidably couples to the second strap such that the second loop extends outwards therefrom vertically in part and laterally therefrom in part.

13. A tie-free apron comprising:

a bib including an upper hem and a pair of spaced-apart side hems;

a pair of cord locks each positioned within a respective one of the pair of spaced-apart side hems of the bib; and a strap assembly including upper end portions that are anchored to and positioned within the upper hem of the bib and including lower end portions configured to extend through the pair of cord locks.

14. A tie-free apron according to claim 13, wherein the bib flares from a bottom thereof towards the upper hem thereof and wherein the bib flares from the upper hem thereof towards the bottom thereof.

15. A tie-free apron according to claim 13, wherein the pair of cord locks are enclosed within the pair of spaced-apart side hems.

16. A tie-free apron according to claim 13, wherein the pair of cord locks are hidden within the pair of spaced-apart side hems.

17. A tie-free apron according to claim 13, wherein the strap assembly includes a cross-shaped portion positioned between the upper end portions thereof and the lower end portions thereof.

18. A tie-free apron according to claim 13, wherein the bib includes a lower hem shaped to promote tensioning outwards of the bib.

19. A tie-free apron according to claim 13, wherein the bib includes a lower hem, with the pair of spaced-apart side hems extending between the upper hem and the lower hem and with the lower hem being wider than the pair of spaced-apart side hems.

20. A tie-free apron according to claim 13, wherein the apron is configured such that the bib thereof has a front which is seamless and free of stitching.

* * * * *